US010700462B2

(12) United States Patent
Schneider

(10) Patent No.: US 10,700,462 B2
(45) Date of Patent: Jun. 30, 2020

(54) CONNECTOR HOUSING

(71) Applicant: Interplex Industries, Inc., East Providence, RI (US)

(72) Inventor: Richard Schneider, Livonia, MI (US)

(73) Assignee: Interplex Industries, Inc., East Providence, RI (US)

( * ) Notice: Subject to any disclaimer, the term of this patent is extended or adjusted under 35 U.S.C. 154(b) by 0 days.

(21) Appl. No.: 16/250,052

(22) Filed: Jan. 17, 2019

(65) Prior Publication Data

US 2019/0221957 A1 Jul. 18, 2019

Related U.S. Application Data

(60) Provisional application No. 62/619,101, filed on Jan. 18, 2018.

(51) Int. Cl.
*H01R 13/502* (2006.01)
*H01R 13/426* (2006.01)
(Continued)

(52) U.S. Cl.
CPC ..... *H01R 13/426* (2013.01); *H01R 12/585* (2013.01); *H01R 12/724* (2013.01);
(Continued)

(58) Field of Classification Search
CPC .. H01R 13/426; H01R 12/724; H01R 13/506; H01R 12/585; H01R 13/04; H01R 13/193; H05K 5/0069
(Continued)

(56) References Cited

U.S. PATENT DOCUMENTS 4,047,242 A 9/1977 Jakob et al.
4,397,513 A 8/1983 Clark et al.
(Continued)

FOREIGN PATENT DOCUMENTS

DE 102015208628 A1 11/2016
EP 1810810 A1 7/2007
(Continued)

OTHER PUBLICATIONS

International Search Report for WO2020-009925, dated Sep. 19, 2019.
(Continued)

*Primary Examiner* — Jean F Duverne
(74) *Attorney, Agent, or Firm* — Katterle Nupp LLC; Paul Katterle; Robert Nupp

(57) ABSTRACT

A connector housing is provided for an electronic/electrical device, which may include a printed circuit board. The connector housing includes a header connector secured to an enclosure. The header connector includes a plastic mounting block defining a plurality of slots. A plurality of contacts is at least partially disposed in the slots of the mounting block, respectively. The contacts each have a first section and a second section. The first section includes a connector end and the second section includes a plurality of retention tabs and a tail end for connection to the electronic/electrical device. The retention tabs extend in the lateral direction and engage the mounting block to help secure the contacts to the mounting block. A keeper is connected to the mounting block such that the tail ends of the contacts protrude from an outer surface of the keeper.

19 Claims, 25 Drawing Sheets

(51) Int. Cl.

| | |
|---|---|
| ***H01R 13/428*** | (2006.01) |
| ***H01R 13/04*** | (2006.01) |
| ***H01R 12/58*** | (2011.01) |
| ***H01R 13/506*** | (2006.01) |
| ***H01R 12/72*** | (2011.01) |

(52) U.S. Cl.
CPC ..... *H01R 13/04* (2013.01); *H01R 13/428* (2013.01); *H01R 13/506* (2013.01)

(58) Field of Classification Search
USPC ..... 439/701
See application file for complete search history.

(56) References Cited

U.S. PATENT DOCUMENTS

| | | | | |
|---|---|---|---|---|
| 5,112,233 | A | 5/1992 | Lybrand | |
| 5,906,518 | A * | 5/1999 | Sun | H01R 13/193 439/295 |
| 6,375,478 | B1 | 4/2002 | Kikuchi | |
| 6,459,042 | B1 | 10/2002 | Stilianos et al. | |
| 6,773,272 | B2 | 8/2004 | Koehler et al. | |
| 7,080,990 | B1 * | 7/2006 | Juntwait | H01R 12/724 439/79 |
| 7,094,075 | B1 | 8/2006 | Lim et al. | |
| 7,195,519 | B1 | 3/2007 | McAlonis et al. | |
| 8,118,583 | B2 | 2/2012 | Nagashima | |
| 8,627,564 | B2 | 1/2014 | Blossfeld et al. | |
| 9,320,165 | B2 * | 4/2016 | Gruber | H05K 5/0069 |
| 2005/0277315 | A1 | 12/2005 | Mongold et al. | |
| 2006/0019516 | A1 | 1/2006 | Nagashima | |
| 2010/0317239 | A1 * | 12/2010 | Achammer | H01R 12/585 439/676 |

FOREIGN PATENT DOCUMENTS

| | | | |
|---|---|---|---|
| WO | WO2015183951 | A1 | 12/2015 |
| WO | WO2020009925 | A1 | 1/2020 |

OTHER PUBLICATIONS

Written Opinion of the International Searching Authority for WO2020-009925, dated Sep. 19, 2019.

* cited by examiner

CONNECTOR HOUSING

CROSS-REFERENCE TO RELATED APPLICATION(S)

This patent application claims the benefit of priority under 35 U.S.C. § 119(e) to Provisional Patent Application No.: 62/619,101, filed on Jan. 18, 2018, which is incorporated herein by reference.

TECHNICAL FIELD

The present disclosure relates to a connector housing for enclosing an electronic/electrical device.

BACKGROUND

A connector housing often includes an enclosure and a header connector for connecting the electronic/electrical device to another device located outside the enclosure. In such a connector housing, the header connector typically includes a plurality of terminal pins mounted to a holding structure. The terminal pins include tail end portions adapted for connection to the electronic/electrical device inside the enclosure and contact end portions that are arranged inside a shroud of the enclosure to form a plug adapted for connection to a mating plug of another device.

A connector housing of the type described above is typically manufactured by mounting the header connector to the electronic/electrical device and then mounting the electronic/electrical device with the header connector inside the enclosure. This method of manufacture, however, has several drawbacks. There are difficulties in handling an electronic/electrical device with a header connector secured thereto and sealing an electronic/electrical device mounted to a header connector can be challenging.

In order to address some of these drawbacks of first mounting the header connector to the electronic/electrical device, it has been proposed to mount the header connector to the enclosure first and then mount the electronic/electrical device to the header connector. However, there are drawbacks to this method as well. It is difficult to produce a housing for the header connector that is able to support the terminal pins and maintain their spacing or pitch when the electronic/electrical device is being mounted to the header connector. This difficulty is exacerbated by the continual miniaturization of electrical connectors, which requires smaller and more fragile terminal pins and closer spacing.

Based on the foregoing, there is a need for an improved connector housing.

SUMMARY

In accordance with the disclosure, a connector housing is provided for an electronic/electrical device. The connector housing includes an enclosure defining an interior space in which the electronic/electrical device may be disposed. The enclosure includes a wall with an opening extending therethrough and a shroud joined to and extending from the wall. A header connector is secured to the enclosure so as to extend through the opening in the wall. The header connector includes a plastic mounting block defining a plurality of slots arranged in a lateral direction. A plurality of contacts is at least partially disposed in the slots of the mounting block, respectively. The contacts each have a first section and a second section. The first section includes a connector end disposed inside the shroud, while the second section includes a plurality of retention tabs and a tail end for connection to the electronic/electrical device. The retention tabs extend in the lateral direction and engage the mounting block to help secure the contacts to the mounting block. A keeper is connected to the mounting block. The keeper has a plurality of passages through which the contacts extend, respectively, so that the tail ends of the contacts protrude from an outer surface of the keeper.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
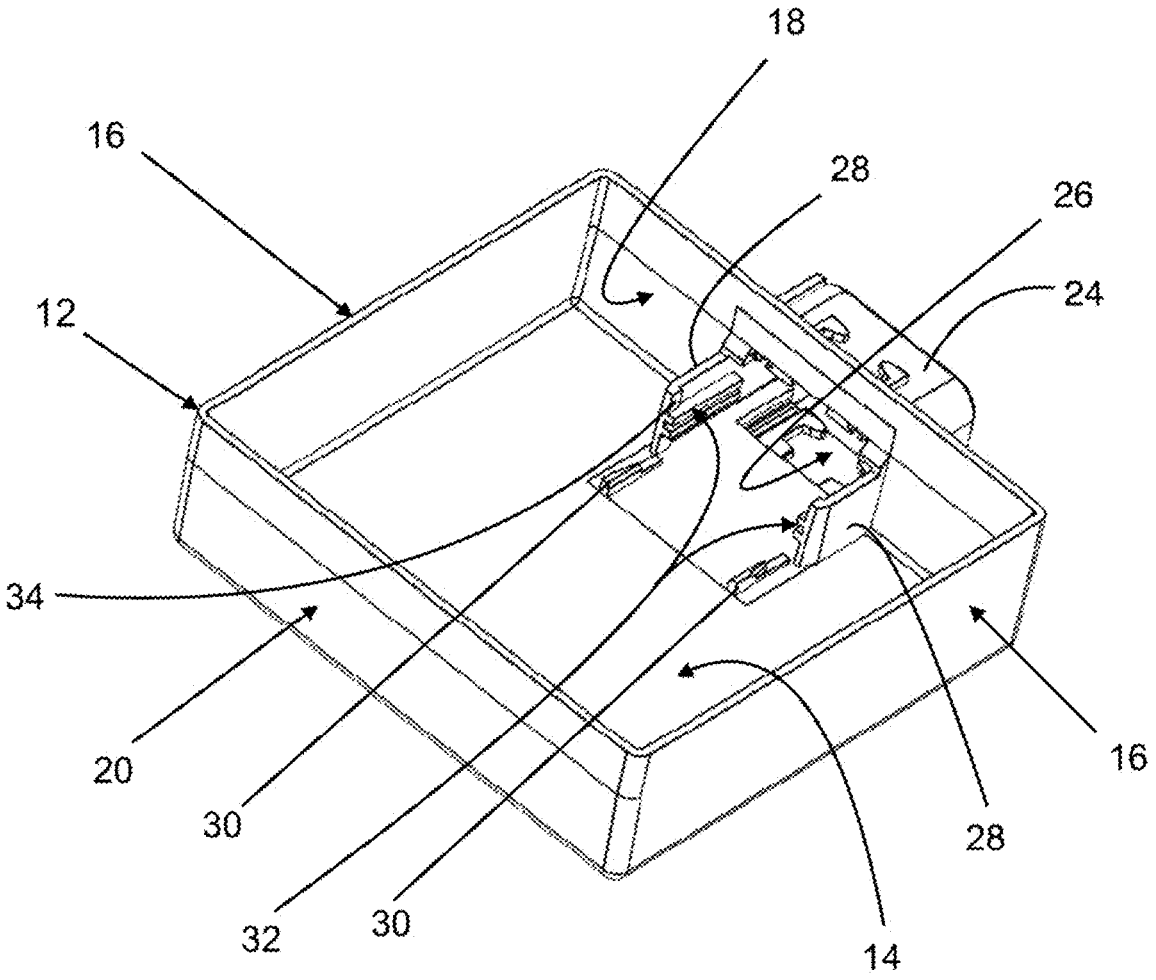
FIG. 1 shows a top perspective view of a portion of an enclosure.
Figure 2:
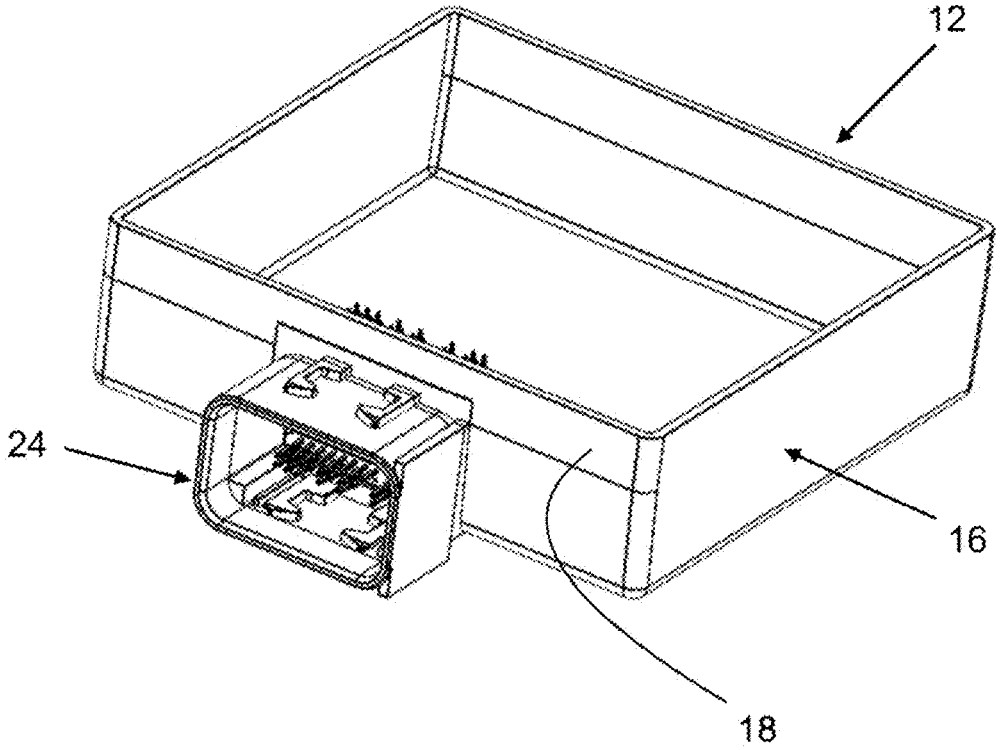
FIG. 2 shows a top front perspective view of a portion of the enclosure with a first embodiment of a connector biscuit secured thereto.

It should be noted that in the detailed description that follows, identical components have the same reference numerals, regardless of whether they are shown in different embodiments of the present disclosure. It should also be noted that for purposes of clarity and conciseness, the drawings may not necessarily be to scale and certain features of the disclosure may be shown in somewhat schematic form.

Spatially relative terms, such as "top", "bottom", "lower", "above", "upper", and the like, are used herein merely for ease of description to describe one element or feature's relationship to another element(s) or feature(s) as they are illustrated in (a) drawing figure(s) being referred to. It will be understood that the spatially relative terms are not meant to be limiting and are intended to encompass different orientations of the device in use or operation in addition to the orientation depicted in the drawings.

The present disclosure is directed to a connector housing that includes a header connector or connector biscuit (40, 100, 250) that is mounted inside an enclosure (12) enclosing an electronic/electrical device. Inside the enclosure (12), the connector biscuit (40, 100, 250) is connected to the electronic/electrical device, which may be a printed circuit board (PCB). The connector biscuit (40, 100, 250) includes a plastic body to which a plurality of contacts (46, 116) are mounted. The body may include a guide system (70, 186) for guiding the connector biscuit (40, 100, 250) into the enclosure 12 and a latching system (72, 188) for releasably securing the connector biscuit (40, 100, 250) within the enclosure 12. The body may be monolithic or formed from multiple components. In one or more embodiments, the body comprises a mounting block (42, 102, 252) disposed adjacent to and/or engaged with a keeper (44, 104, 254). The keeper (44, 104, 254) maintains the alignment of the tail ends (76, 120) of the contacts (46,116) that are to be connected to the electrical and/or electronic device, while the mounting block (42, 102, 252) supports the contacts (46,116) and provides a reaction force against the pressure created by the connection of the electrical and/or electronic device to the contacts (46,116). The mounting block (42, 102, 252) may be monolithic or formed from multiple components. In one or more embodiments, the mounting block (42, 102, 252) may comprise a comb (110, 256) connected to a bulkhead (112, 258). In addition, the contacts (46,116) may be contained within one or more contact modules (108, 312) that are held between the comb (110, 256) and the bulkhead (112, 258).

The enclosure 12 defines an enlarged cavity within which electronic circuitry may be disposed. This electronic circuitry includes the electronic/electrical device (e.g. a PCB) connected to the connector biscuit (40, 100, 250). The enclosure 12 may have any type of construction and configuration suitable for the structure and function of the electronic circuitry. In one or more embodiments, the enclosure 12 may be box-shaped and include a bottom wall 14, opposing side walls 16, a front wall 18 and a rear wall 20. Although not shown, the enclosure 12 may further include a top lid or cover. A generally rectangular shroud 24 may be integrally joined to, and extend from, the front wall 18. The enclosure 12 may be composed of thermoplastic and at least the bottom portion thereof may be molded in one piece.

The shroud 24 has rounded corners and defines an inner cavity that adjoins an opening 26 in the front wall 18 to provide access to the interior of the enclosure 12. A pair of interior walls 28 are joined to the bottom wall 14 and extend rearwardly from the front wall 18, on opposing sides of the opening 26. A pair of spaced-apart bottom tracks 30 are secured to the bottom wall 14 and are located rearward of the interior walls 28. A pair of side tracks 32 are joined to the interior walls 28, respectively. Each side track 32 comprises a pair of ledges that define a groove therebetween. As will be described more fully below, the grooves are adapted to receive rails (70, 186), respectively, of a connector biscuit (40, 100, 250). Above each side track 32, a stop projection 34 is joined to the interior wall 28. As will be described more fully below, the stop projections 34 engage with latches (72, 188) of the connector biscuit (40, 100, 250) to retain the connector biscuit (40, 100, 250) in the enclosure 12.

Figure 3:
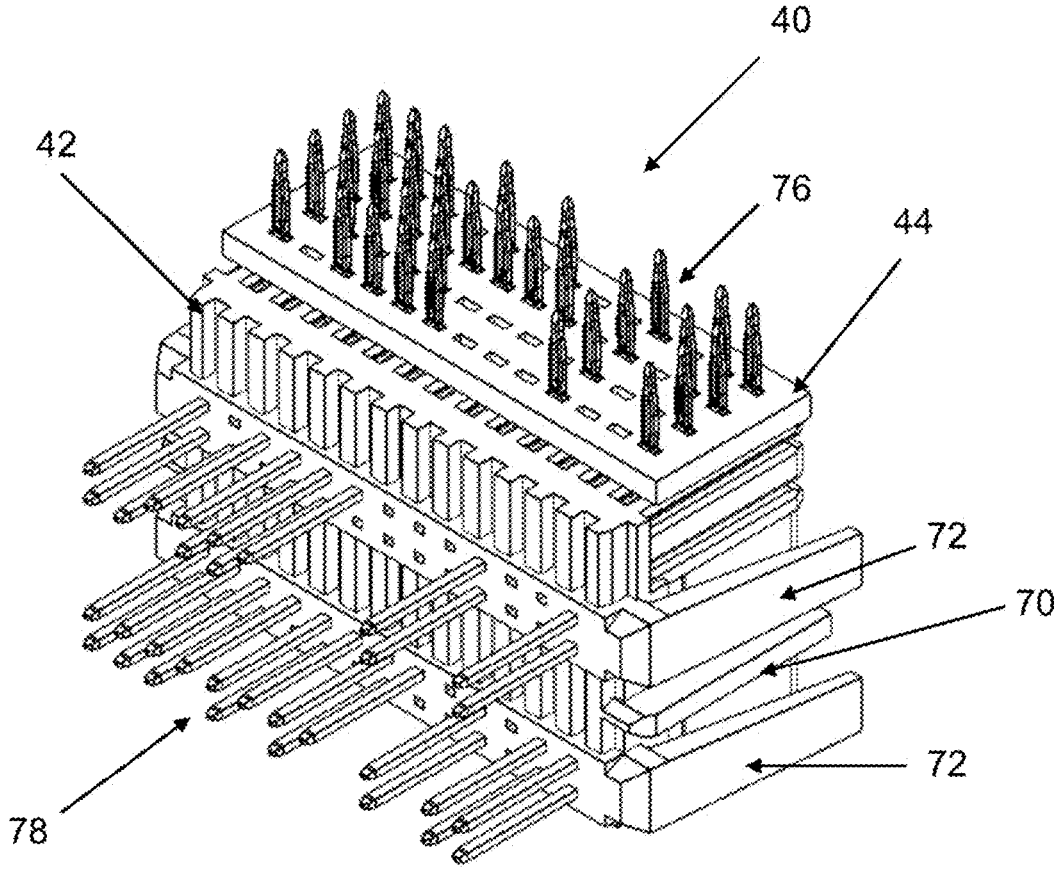
FIG. 3 shows a top front perspective view of the first embodiment of the connector biscuit.
Figure 4:
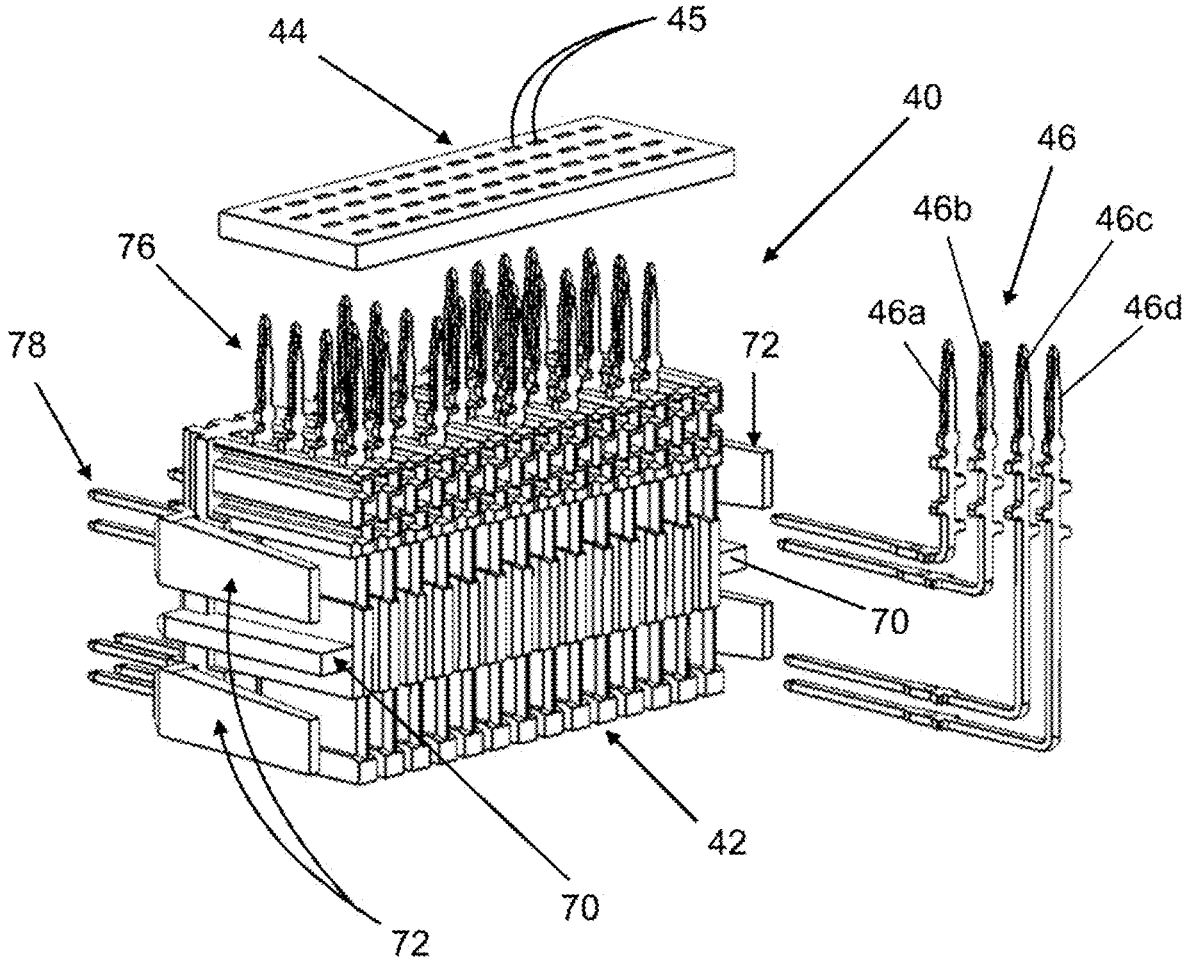
FIG. 4 shows a partially exploded rear perspective view of the first embodiment of the connector biscuit.

Referring specifically now to FIGS. 3 and 4, there is shown a connector biscuit 40 constructed in accordance with an exemplary, non-limiting first embodiment. The connector biscuit 40 generally includes a body consisting of a mounting block 42 and a keeper 44, with a plurality of contacts 46 mounted thereto.

Figure 5:
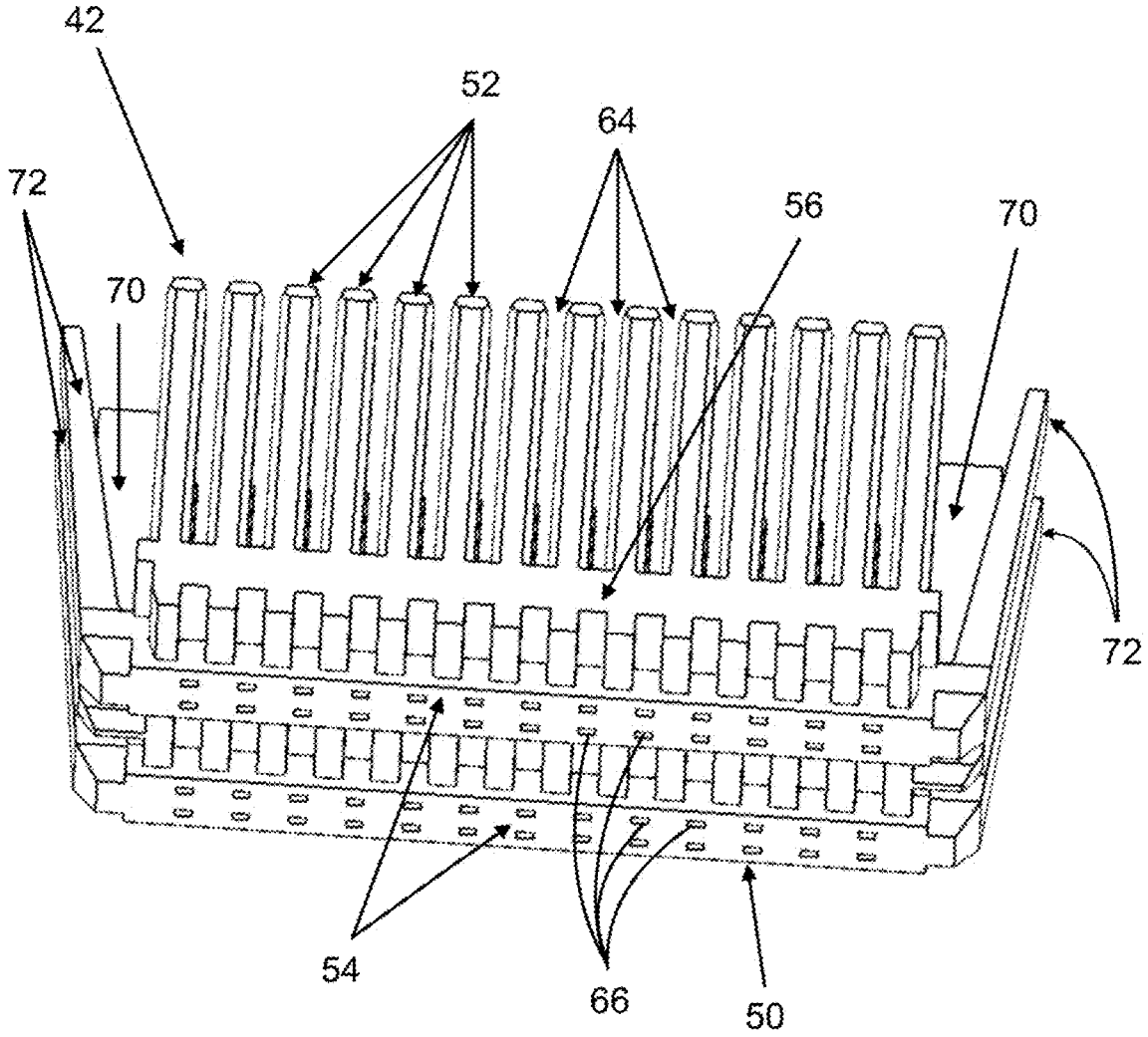
FIG. 5 shows a top front perspective view of a mounting block of the first embodiment of the connector biscuit.
Figure 6:
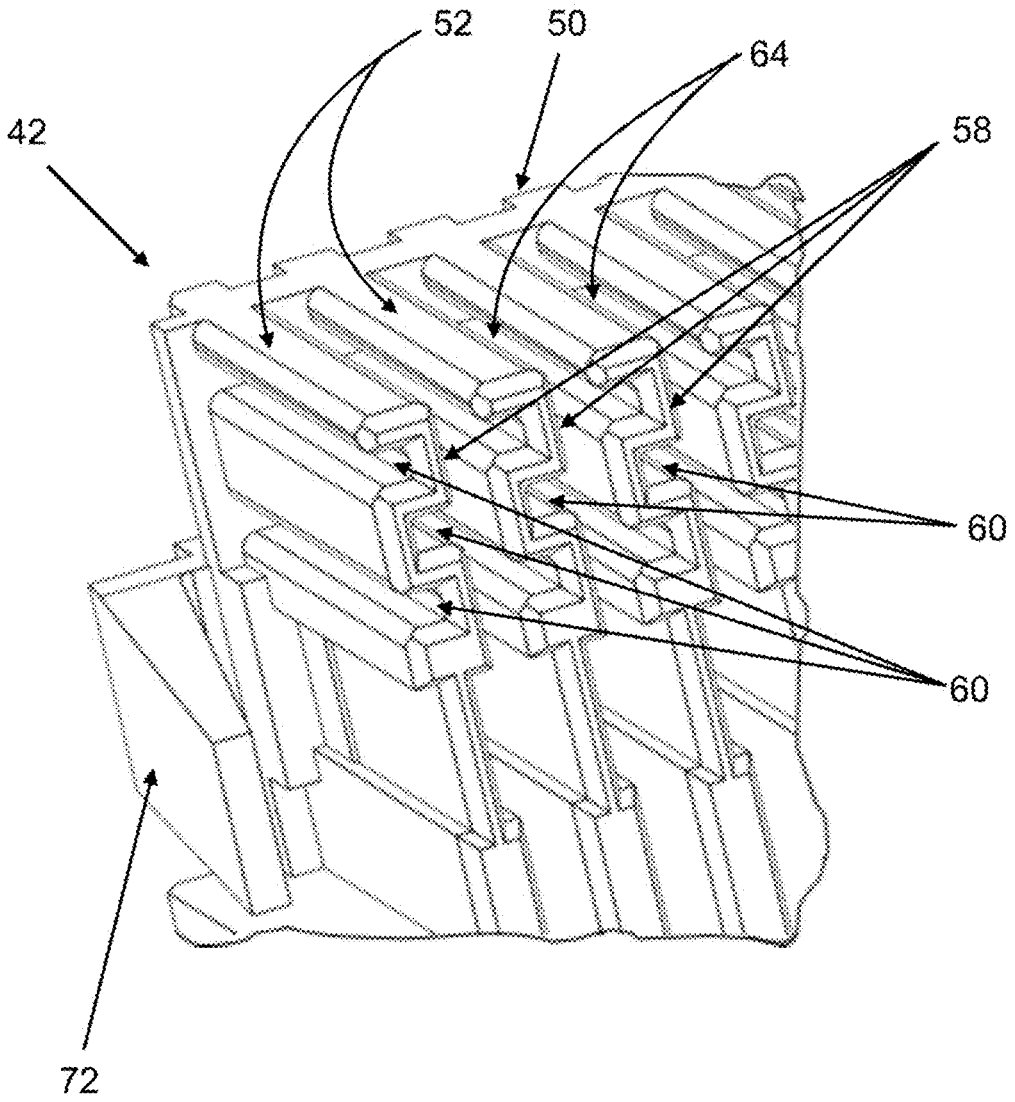
FIG. 6 shows a rear perspective view of a portion of the mounting block of the first embodiment of the connector biscuit.
Figure 7:
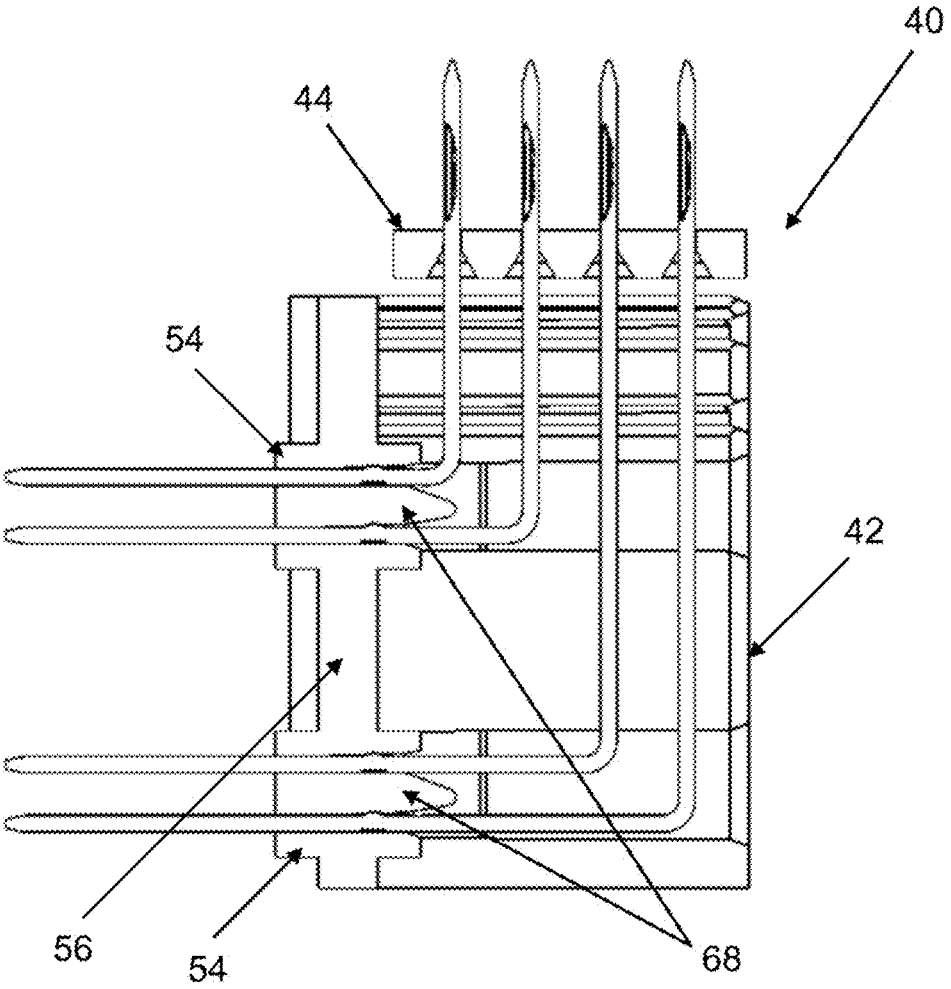
FIG. 7 shows a side sectional view of the mounting block of the first embodiment of the connector biscuit, having contacts mounted thereto.

Referring now also to FIGS. 5-7, the mounting block 42 may be composed of thermoplastic and may be a unitary or monolithic structure. The mounting block 42 includes a front structure 50 joined to a series of sidewalls 52. The front structure 50 includes a pair of braces 54 integrally joined with a front wall 56. Each sidewall 52 includes an upper crenelated portion 58 having a plurality of channels 60, at least two of which are oppositely-directed. As shown, each sidewall 52 may have two channels 60 opening in one direction and a third channel 60 opening in an opposite, second direction. The sidewalls 52 are spaced-apart to form a series of parallel slots 64. Each slot 64 is defined by a sidewall 52 having a pair of channels 60 opening into the slot 64 and an opposing sidewall 52 having a single channel 60 opening into the slot 64, with the single channel 60 in the one sidewall 52 being vertically positioned between the pair of channels 60 in the other sidewall 52. Within each slot 64, each of the braces 56 define a pair of passages 66, respectively. Each of the braces 54 has a center portion 68 (shown in FIG. 7) that separates the passages 66. A rearwardly-directed portion of the center portion 68 is tapered to help guide contacts 46 into the passages 66. The passages 66 each have a sloping roof.

The outermost sidewalls 52 each have a rail 70 disposed between a pair of spaced-apart latches 72. The latches 72 are each joined at one end to one of the braces 54. The latches 72 are resiliently deflectable inwardly, towards the sidewalls 52, respectively. The rails 70 are adapted to be received in the grooves of the side tracks 32 of the interior walls 28, while free ends of the latches 72 are adapted to engage the stop projections 34 of the interior walls 28.

Figure 8:
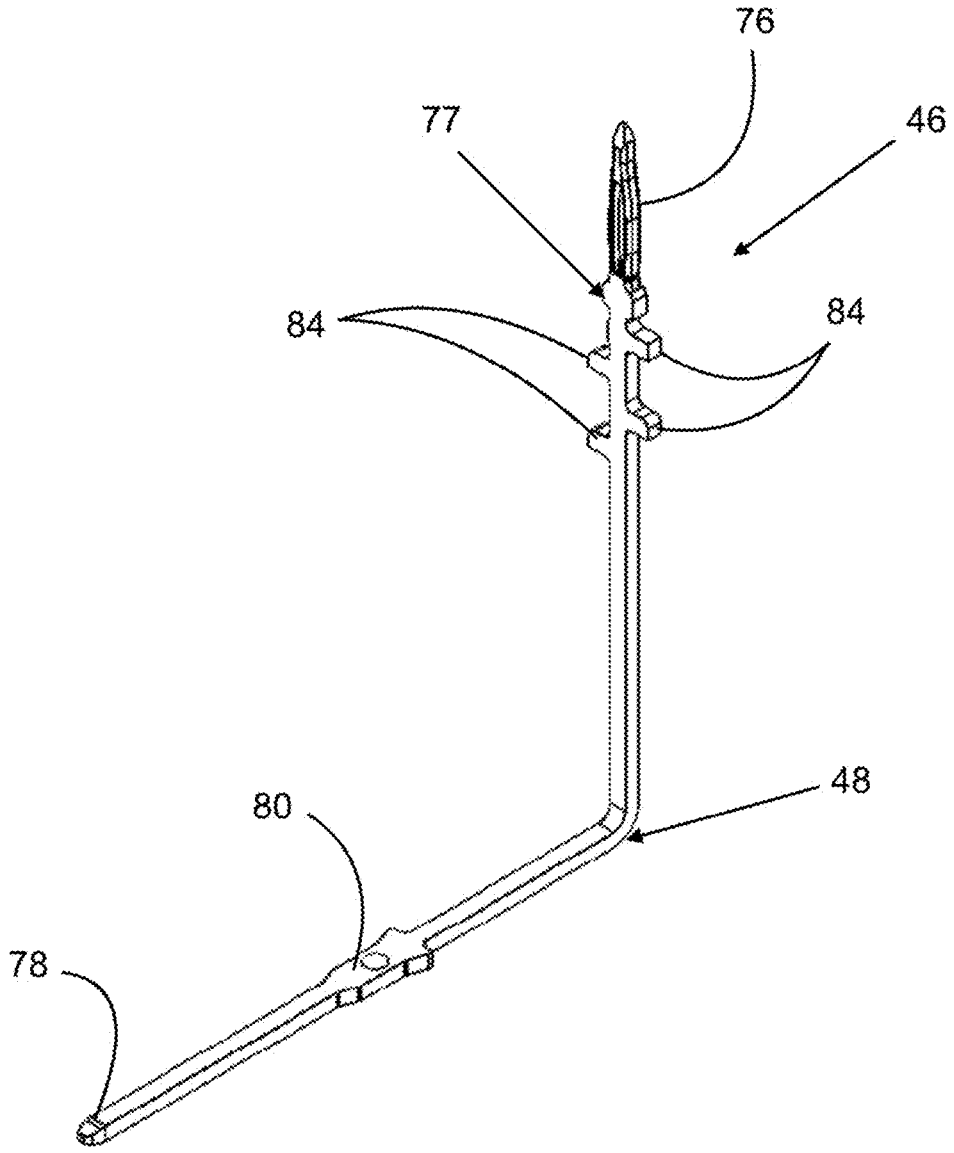
FIG. 8 shows a front perspective view of a contact of the first embodiment of the connector biscuit.
Figure 9:
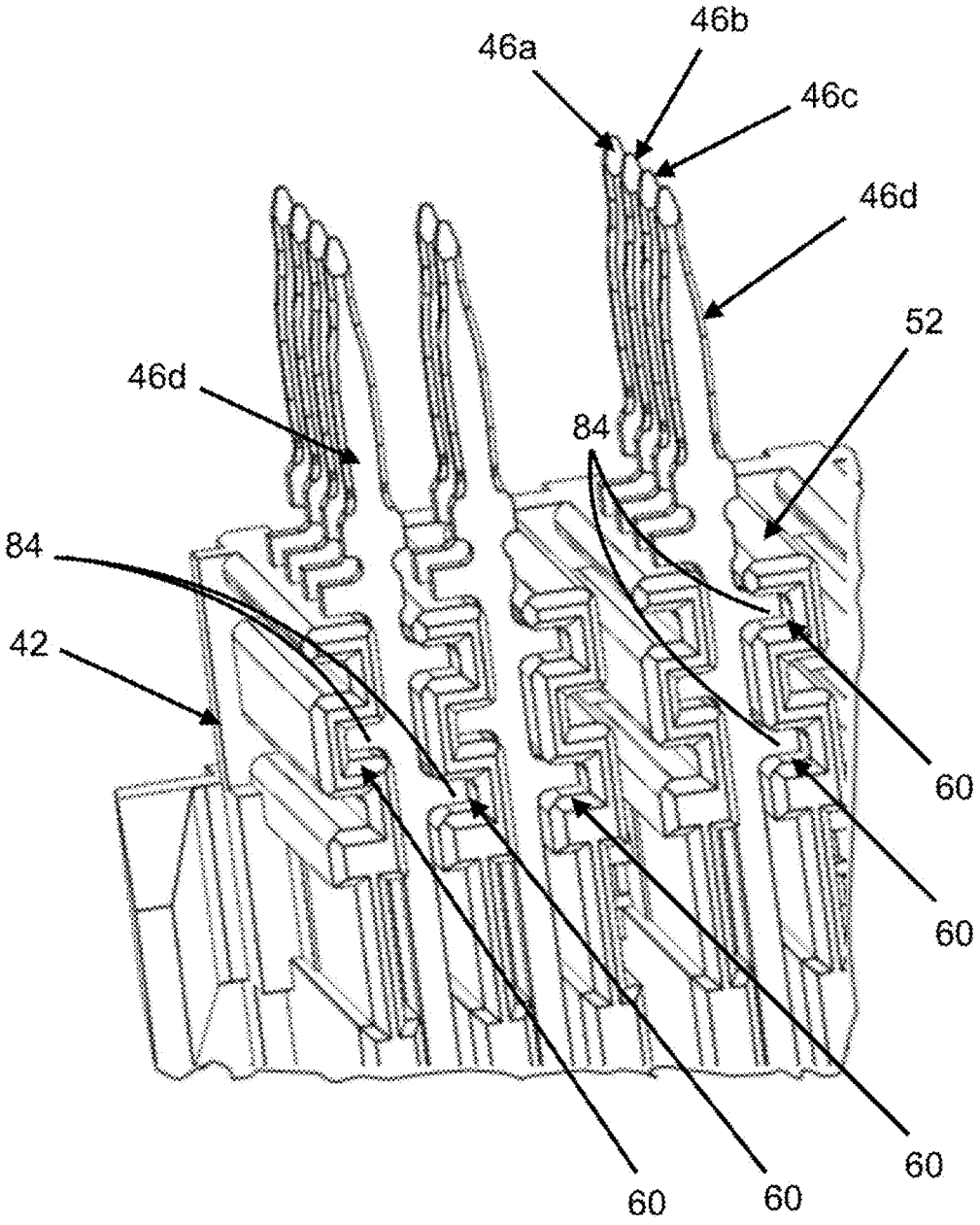
FIG. 9 shows a rear perspective view of a portion of the mounting block of the first embodiment of the connector biscuit, showing the mounting of contacts thereto.

Referring now also to FIG. 8, there is shown one of the contacts 46. The contact 46 is composed of an electrically conductive metal, such as a tin plated copper alloy, and has a unitary or monolithic structure. The contact 46 is L-shaped and has an upper section with a tail end 76, a middle section with a bend 48 and a lower section with a connector end 78. The tail end 76 may have a press-fit construction (such as an EON construction) that is adapted for insertion into a plated hole of a PCB. The connector end 78 may be pin-shaped. The lower section has a barb 80 with an embossed bump. The upper section includes a tapered retainer 77 and a series of retention tabs 84, all located toward the tail end 76. The middle section extends between the lowermost retention tab 84 and the barb 80. The retention tabs 84 are arranged in a staggered configuration, with two of the retention tabs 84 extending from one side of the contact 46 and the other two extending from the other side of the contact 46. The three inner or lower retention tabs 84 are disposed in the channels 60, respectively, of a slot 64 of the mounting block 42, while the uppermost retention tab 84 rests on a top surface of a sidewall 52, as shown in FIG. 9. In this manner, plastic of the mounting block 42 is disposed between retention tabs 84 on each side of a contact 46. Moreover, the peripheral edge of each of the inner or lower retention tabs 84 is surrounded by the plastic. As such, the retention tabs 84 help secure the contacts 46 in the mounting block 42.

Four different variations of the contact 46 may be used in the connector biscuit 40 and are designated as 46*a,b,c,d*, with all of them having the same construction, except for the (unbent) length of their middle section. The (unbent) length of the middle section of the contact 46*a* is shorter than that of the contact 46*b*, which is substantially shorter than that of the contact 46*c*, which is shorter than that of the contact 46*d*. The contacts 46 are mounted in the slots 64 of the connector biscuit 40 such that each slot 64 may contain up to one set of the four contacts 46*a,b,c,d*, with the barbs 80 of the contacts 46*a,b* being disposed in the passages 66 of an upper one of the braces 54 and the barbs 80 of the contacts 46*c,d* being disposed in the passages 66 of a lower one of the braces 54. The embossed bumps on the barbs 80 engage the sloping roofs of the passages 66, respectively, which helps ensure that the lower sections of the contacts 46 are horizontally oriented. In each slot 64 containing a full set of the contacts 46*a,b,c,d*, the contacts 46 are arranged front to back in the order 46*a*, then 46*b*, then 46*c* and then 46*d*, with the contact 46*a* being the frontmost and the contact 46*d* being the rearmost, as shown in FIGS. 4 and 9.

The contacts 46 may be inserted into the slots 64 of the connector biscuit 40 in their L-shaped configuration, i.e., after they have been bent. Alternately, the contacts 46 may be inserted into the slots 64 before they are bent, i.e., when they are straight, and then, afterwards, they may then be bent upward.

As shown in FIGS. 3 and 4, when mounted to the mounting block 42, the contacts 46 form a matrix of tail ends 76 protruding from a top side of the mounting block 42 and a matrix of connector ends (pins) 78 protruding from a front side of the mounting block 42. The matrix of tail ends 76 may be comprised of columns of up to four tail ends 76 and rows of up to thirteen tail ends 76, while the matrix of connector pins 78 may be comprised of two spaced-apart sets of rows, with each set of rows comprising a pair of rows of up to thirteen connector pins 78. However, depending on a particular application, the maximum number of contacts 46 may not be mounted to the mounting block 42, which is the case shown. In such an event, not every slot 64 contains a full set of contacts 46*a,b,c,d*. Indeed, some slots 64 may contain one, two or three contacts 46 or no contacts 46 at all. Moreover, the mounting block 42 may be configured to accommodate a lesser or a greater number of contacts 46 to permit different sizes of matrices of tail ends 76 and connector pins 78. Of course, the number of different contacts 46 and their arrangement is dependent on the particular application of the connector biscuit 40.

The keeper 44 is composed of plastic and has a rectangular panel shape, with a matrix of slotted openings 45 extending therethrough. The outline of the keeper 44 substantially corresponds to the outline of the top side of the mounting block 42 and the matrix of openings 45 in the keeper 44 corresponds to and aligns with the matrix of contact tail ends 76 protruding from the mounting block 42. The keeper 44 is connected to the mounting block 42 by aligning the matrix of keeper openings with the matrix of contact tail ends 76 and then pressing the keeper 44 downward, toward the mounting block 42, which causes the tail ends 76 of the contacts 46 to pass through the openings and the retainers 77 of the contacts 46 to be pressed into engagement with interior walls defining the openings 45 of the keeper 44. The frictional forces between the contact retainers 77 and the side walls of the keeper openings secures the keeper 44 to the mounting block 42. Although not shown, the keeper 44 may include upwardly-extending pillars (such as the pillars 206 shown in the second embodiment), which may extend through openings in the electronic/electrical device (e.g. a PCB). In this manner, the pillars would help align and secure the electronic/electrical device to the connector biscuit 40.

Figure 10:
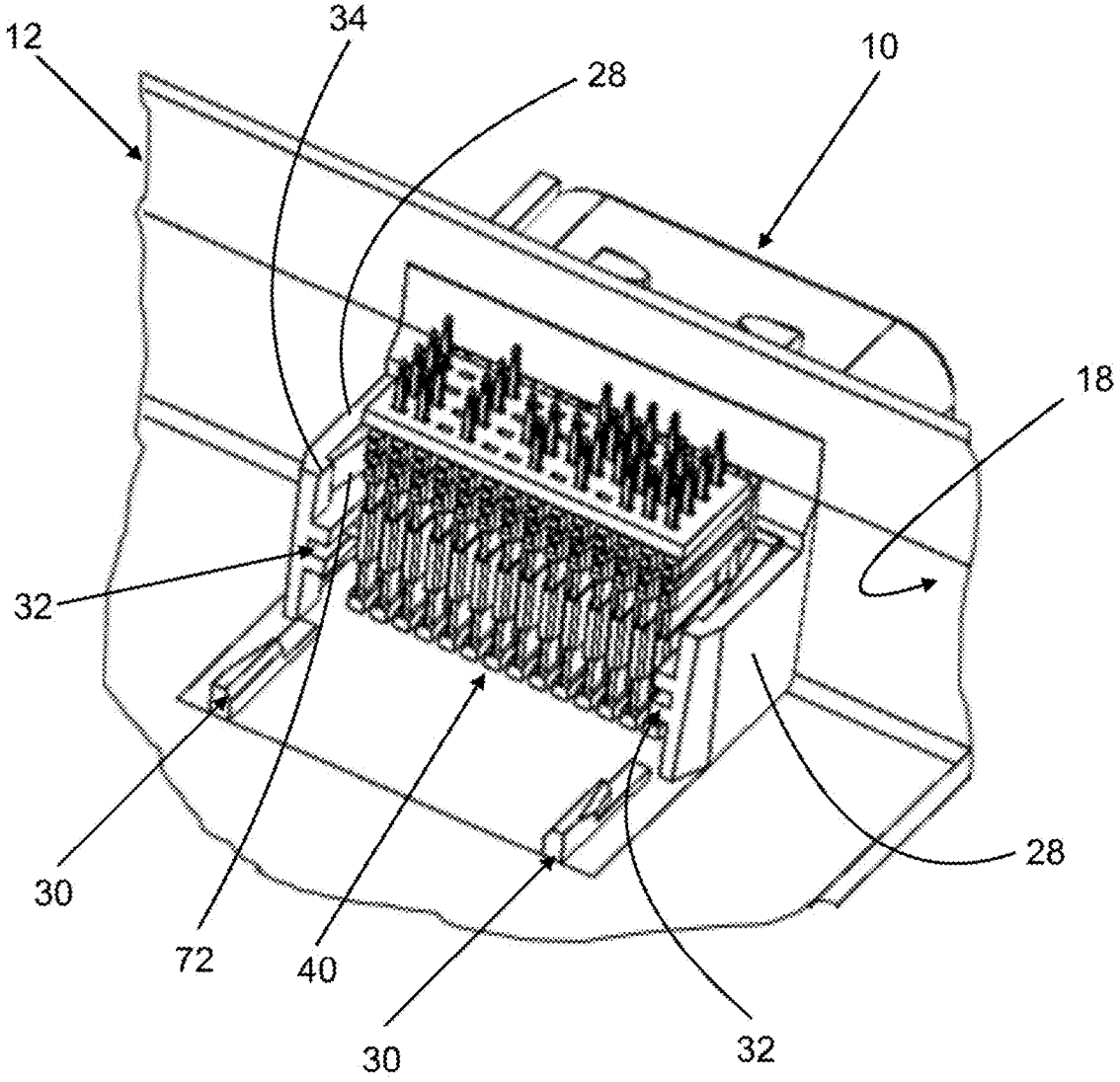
FIG. 10 shows a top perspective view of a portion of the enclosure with the first embodiment of the connector biscuit secured thereto.

Referring now to FIG. 10, the connector biscuit 40 is mounted to the enclosure 12 by placing the connector biscuit 40 inside the enclosure 12, with the mounding block 42 resting on the bottom wall 14 and disposed between the bottom tracks 30. The connector biscuit 40 is then pushed forward such that the rails 70 enter and move through the grooves of the side tracks 32 of the interior walls 28. This forward movement deflects the latches 72 toward the side walls 52 of the mounting block 42, which allows the latches 72 to move between the interior walls 28. Forward movement of the connector biscuit 40 ceases when the front side of the mounting block 42 contacts front stops of the enclosure 12. At this point, the free ends of the latches 72 just clear the stop projections 34, which allows the latches 72 to move outward and place the free ends in close proximity with forward surfaces of the stop projections 34, thereby preventing rearward movement of the connector biscuit 40. The connector biscuit 40 is now secured within the enclosure 12, with the connector ends 78 of the contacts 46 being disposed inside the shroud 24 and the tail ends 76 of the contacts 46 being disposed inside the cavity of the enclosure 12.

Figure 11:
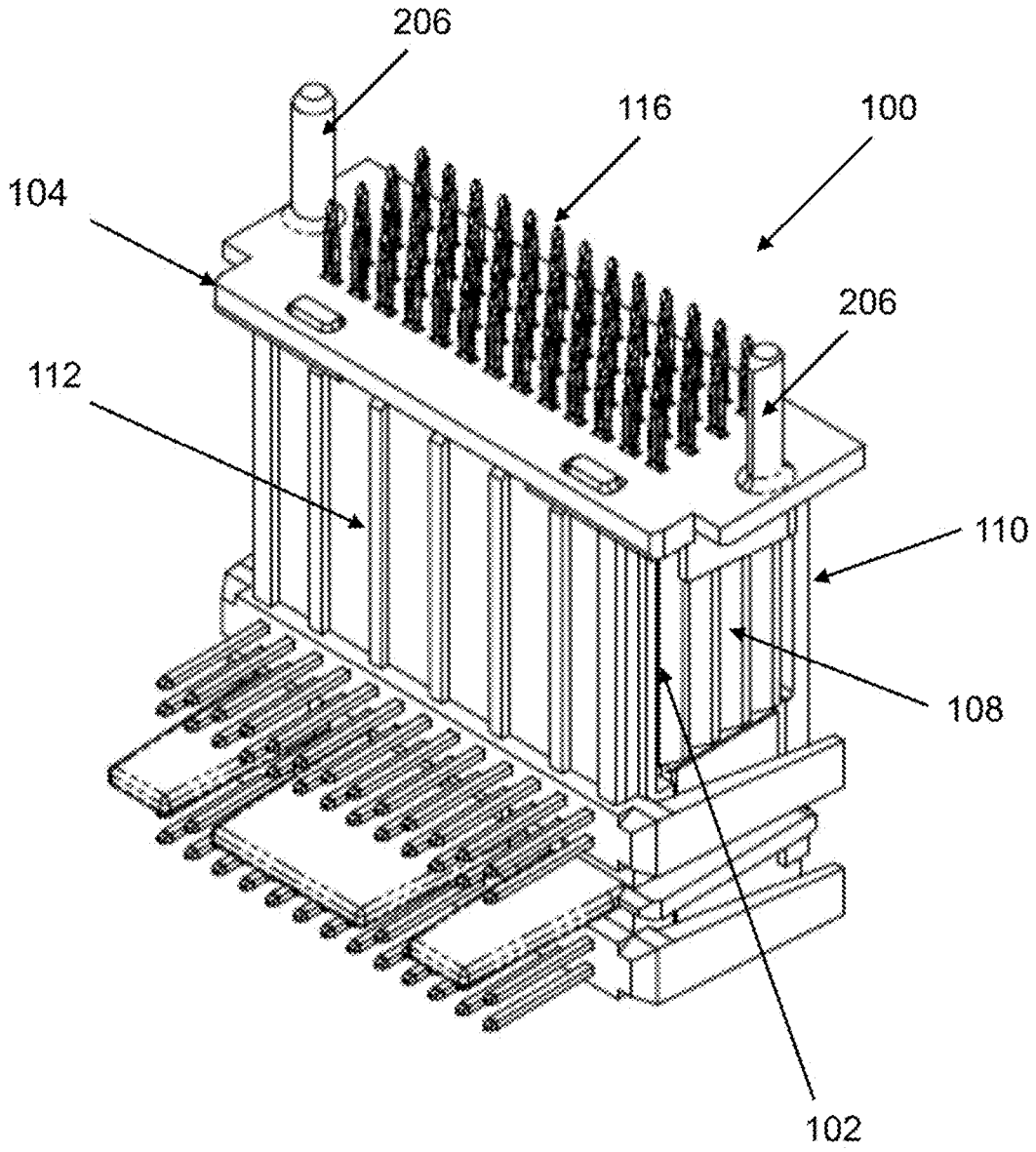
FIG. 11 shows a top front perspective view of a second embodiment of a connector biscuit.
Figure 12:
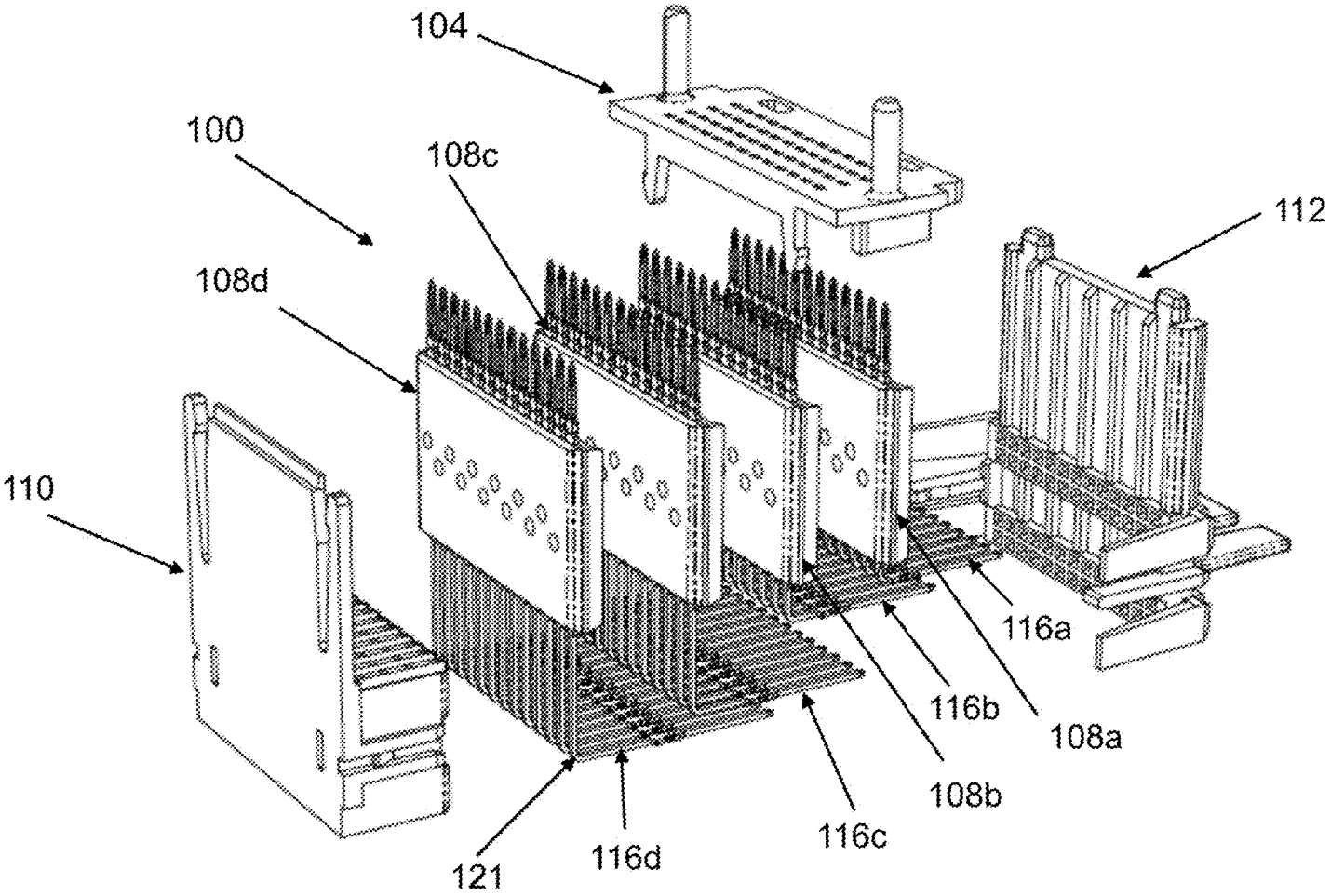
FIG. 12 shows an exploded view of the second embodiment of the connector biscuit.

Referring now to FIGS. 11 and 12, there is shown a connector biscuit 100 constructed in accordance with an exemplary second embodiment. The connector biscuit 100 generally includes a body consisting of a mounting block 102 and a keeper 104, with a plurality of contacts 116 mounted thereto. The mounting block 102 comprises a plurality of contact modules or wafers 108 mounted between a comb 110 and a bulkhead 112.

Figure 13:
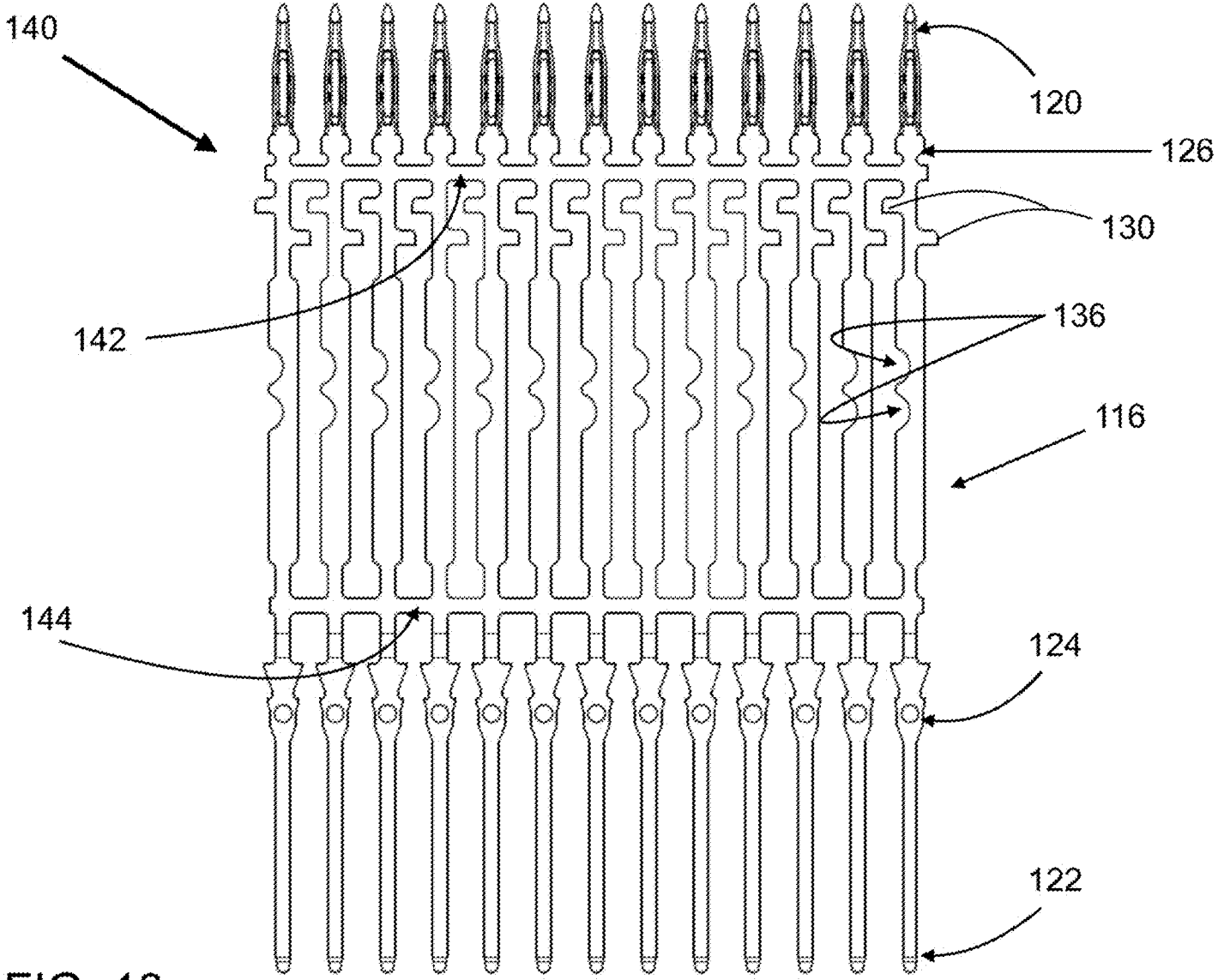
FIG. 13 shows a plan view of a stamping containing a row of contacts for the second embodiment of the connector biscuit.
Figures 14, 15, 16, 17:
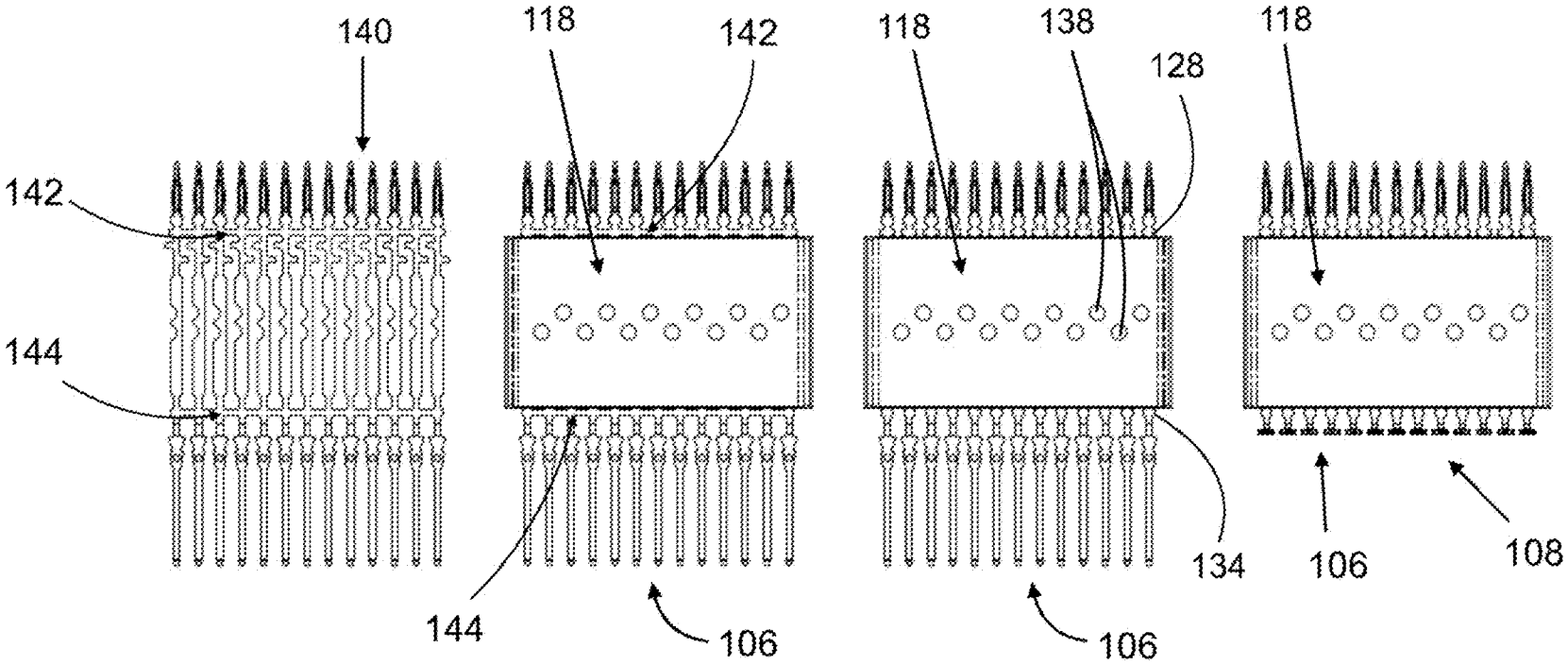
FIGS. 14-17 show stages of manufacture of a contact wafer of the second embodiment of the connector biscuit.

Referring now also to FIG. 13, each of the contact wafers 108 includes a row of contacts 116 securedly fixed in a plastic housing 118, which may be overmolded over the contacts 116. Each contact 116 is composed of an electrically conductive metal, such as a tin plated copper alloy, and has a unitary or monolithic structure. The contact 116 is L-shaped and has an upper section with a tail end 120, a middle section with a bend 121 (shown in FIG. 12) and a lower section with a connector end 122. The tail end 120 may have a press-fit construction (such as an EON construction) that is adapted for insertion into a plated hole of a PCB. The connector end 122 may be pin-shaped. The lower section has a barb 124 with an embossed bump. The upper section also includes a tapered retainer 126, an upper pair of shoulders 128 (shown in FIG. 16), retention tabs 130 and a pair of lower shoulders 134 (shown in FIG. 16). The retention tabs 130 are arranged in a staggered configuration, with one retention tab 130 extending to one side and the other retention tab 130 extending to the other side. The retention tabs 130 help secure the contacts 116 in the housing 118. Upper and lower depressions 136 may be formed in the upper section of the contact 116, between a lowermost one of the retention tabs 130 and the lower shoulders 134. These depressions 136 may be engaged with holding pins during the molding of the housing 118 to prevent the contacts 116 from moving. The holding pins form circular openings 138 in the housing 118.

As shown in FIGS. 14-17, the contact wafers 108 may be formed by a process that utilizes a unitary or monolithic stamping 140 containing a row of the contacts 116. The contacts 116 are connected together by upper and lower tie bars 142, 144. The housing 118 is overmolded over the stamping 140 using a molding tool that includes the holding pins. The holding pins are engaged with the upper and lower depressions 136 in a staggered manner such that a holding pin engages an upper depression 136 in one contact 116 and another holding pin engages a lower depression 136 in an adjacent contact 116, and so on. After the overmolding of the housing 118, the tie bars 142, 144 are cut or punched to separate the contacts 116 and form the upper and lower shoulders 128, 134. The contacts 116 are then bent to form their L-shaped configuration.

When the contacts 116 are ovemolded with plastic to form the housing 118, the retention tabs 130 of the contacts 116 become embedded in the plastic, i.e., are surrounded by the plastic, which helps secure the contacts 116 within the housing 118.

Four different variations of the contact wafer 108 may be used in the connector biscuit 100 and are designated as 108*a,b,c,d*, with all of them having the same construction, except for the (unbent) lengths of their contacts 116, designated 116*a,b,c,d*, respectively. More specifically, the (unbent) lengths of the middle sections of the contacts 116*a,b,c,d* are different. The (unbent) length of the middle section of the contact 116*a* is shorter than that of 116*b*, which is substantially shorter than that of 116*c*, which is shorter than that of 116*d*. Within the mounting block 102, the contact wafers 108 are arranged front to back in the order 108*a*, then 108*b*, then 108*c* and then 108*d*, with the contact wafer 108*a* being the frontmost and the contact wafer 108*d* being the rearmost.

It should be appreciated that additional contact wafers 108 having different (unbent) lengths of the contacts 116 may be provided. In addition, the number of contacts 116 may be changed and may not be the same among the different contact wafers 116. Moreover, in other embodiments, more than four or less than four of the contact wafers 108 may be utilized. All of the foregoing modifications may be made, dependent on the requirements of a particular application.

Figure 18:
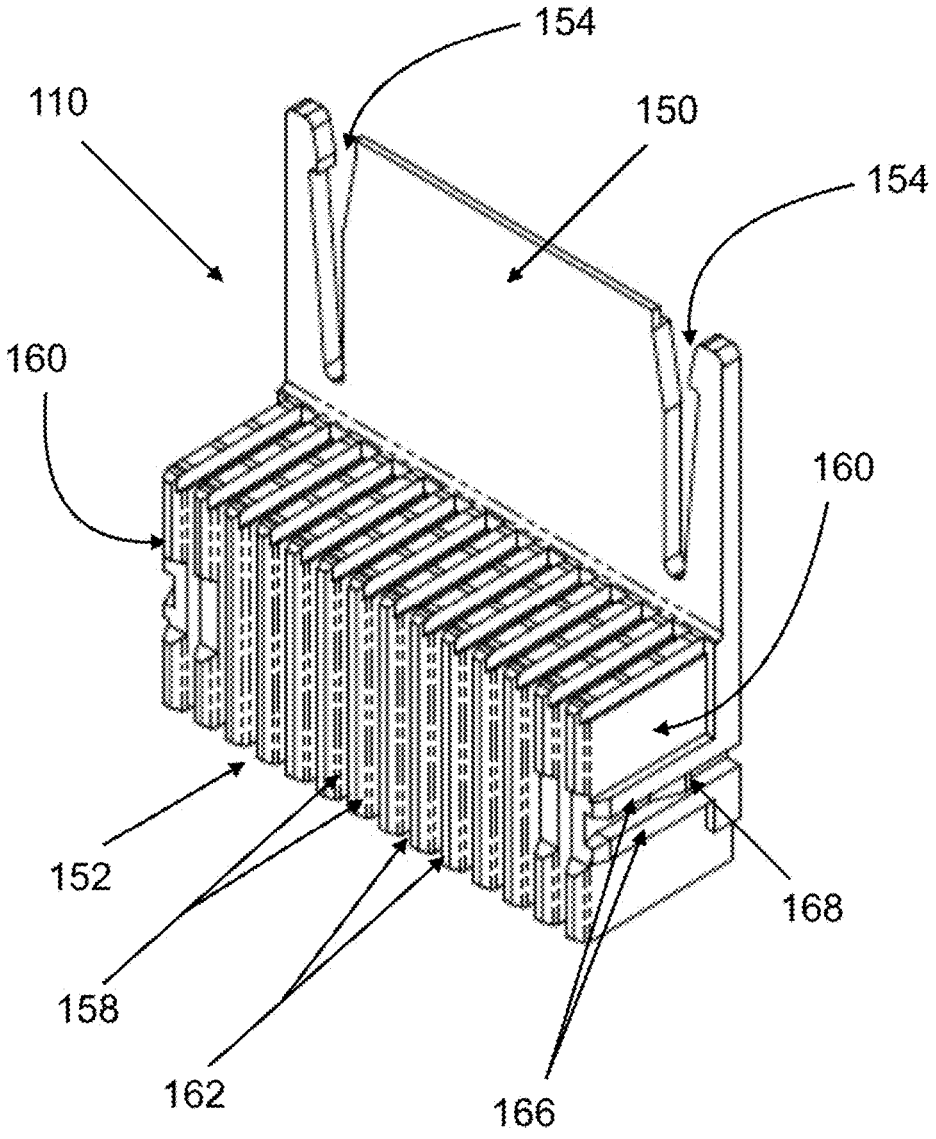
FIG. 18 shows a top front perspective view of a comb of the second embodiment of the connector biscuit.
Figure 19:
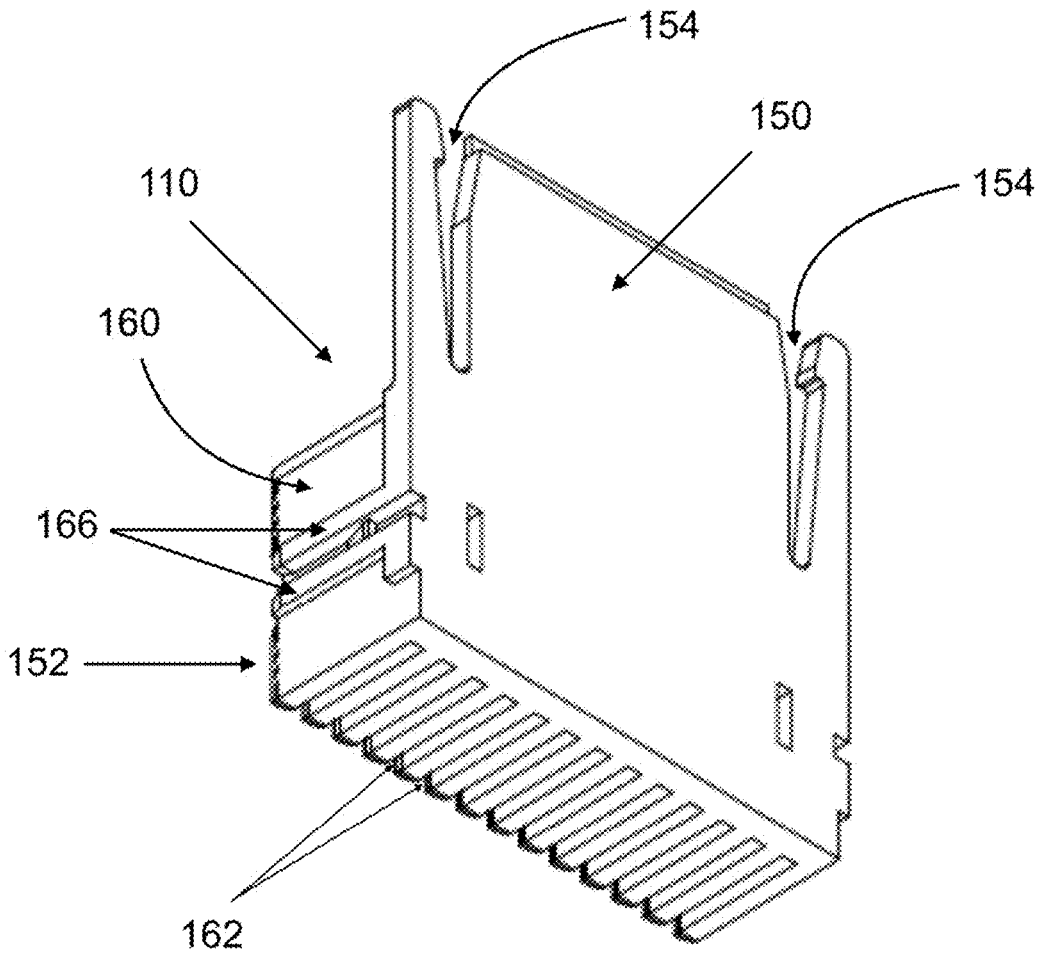
FIG. 19 shows a bottom rear perspective view of the comb of the second embodiment of the connector biscuit.

Referring now to FIGS. 18 and 19, the comb 110 may be composed of thermoplastic and may be a unitary or monolithic structure. The comb 110 is generally chair-shaped, having a vertically-extending back panel 150 integrally joined to a base 152. The back panel 150 is planar and generally rectangular. A pair of snap-fit openings 154 are formed in opposing sides of the back panel 150, toward the top thereof. The base 152 is composed of a plurality of walls 158, 160 that are joined to the back panel 150 and extend forwardly therefrom. The walls 158, 160 are spaced-apart so as to form a series of slots 162. The walls 158, 160 include a plurality of inner walls 158 disposed between a pair of outer walls 160. Each outer wall 160 includes a pair of protruding beams 166 defining a groove therebetween. Wedge-shaped catches 168 are disposed in the groove.

Figure 20:
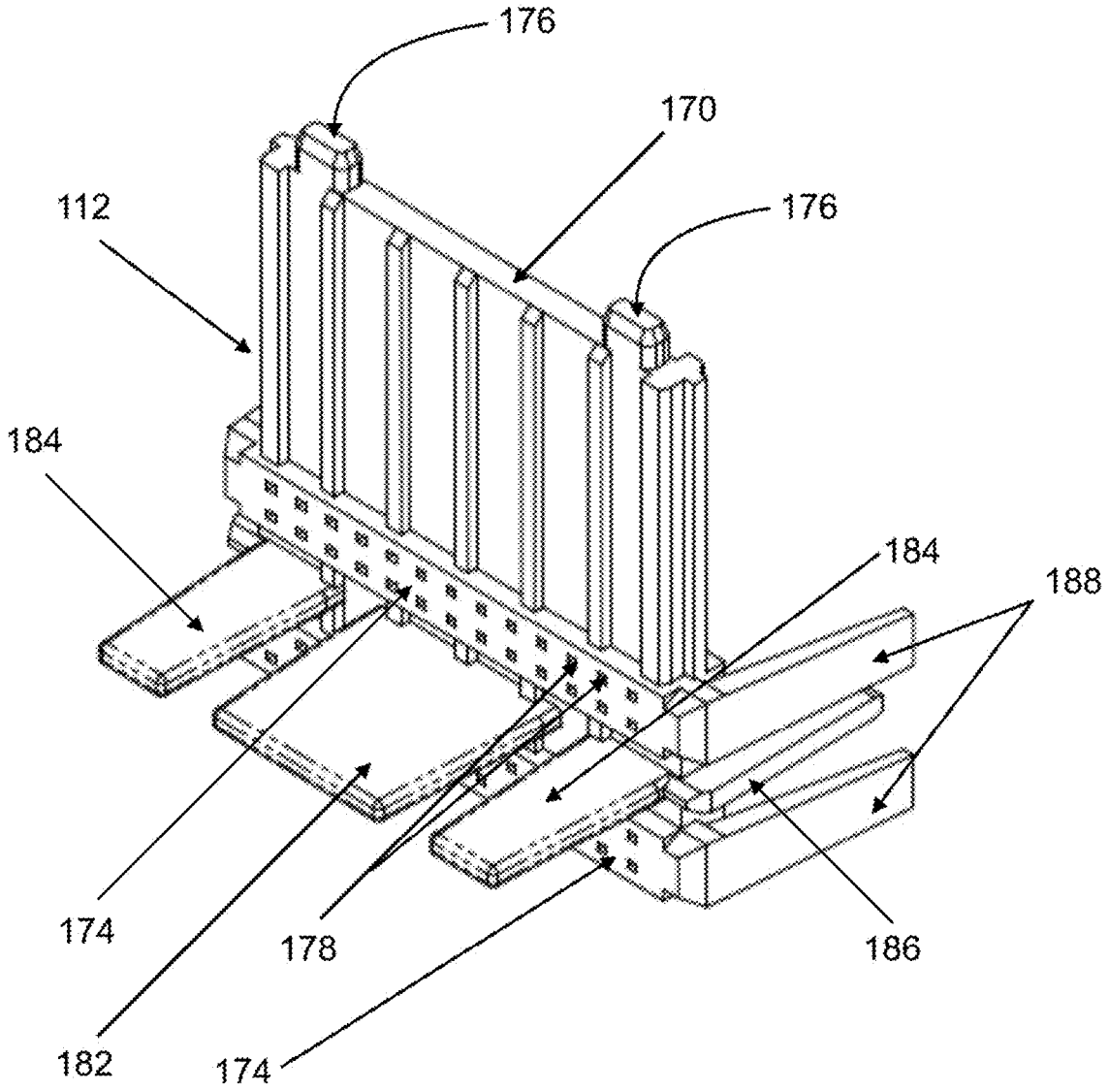
FIG. 20 shows a top front perspective view of a bulkhead of the second embodiment of the connector biscuit.
Figure 21:
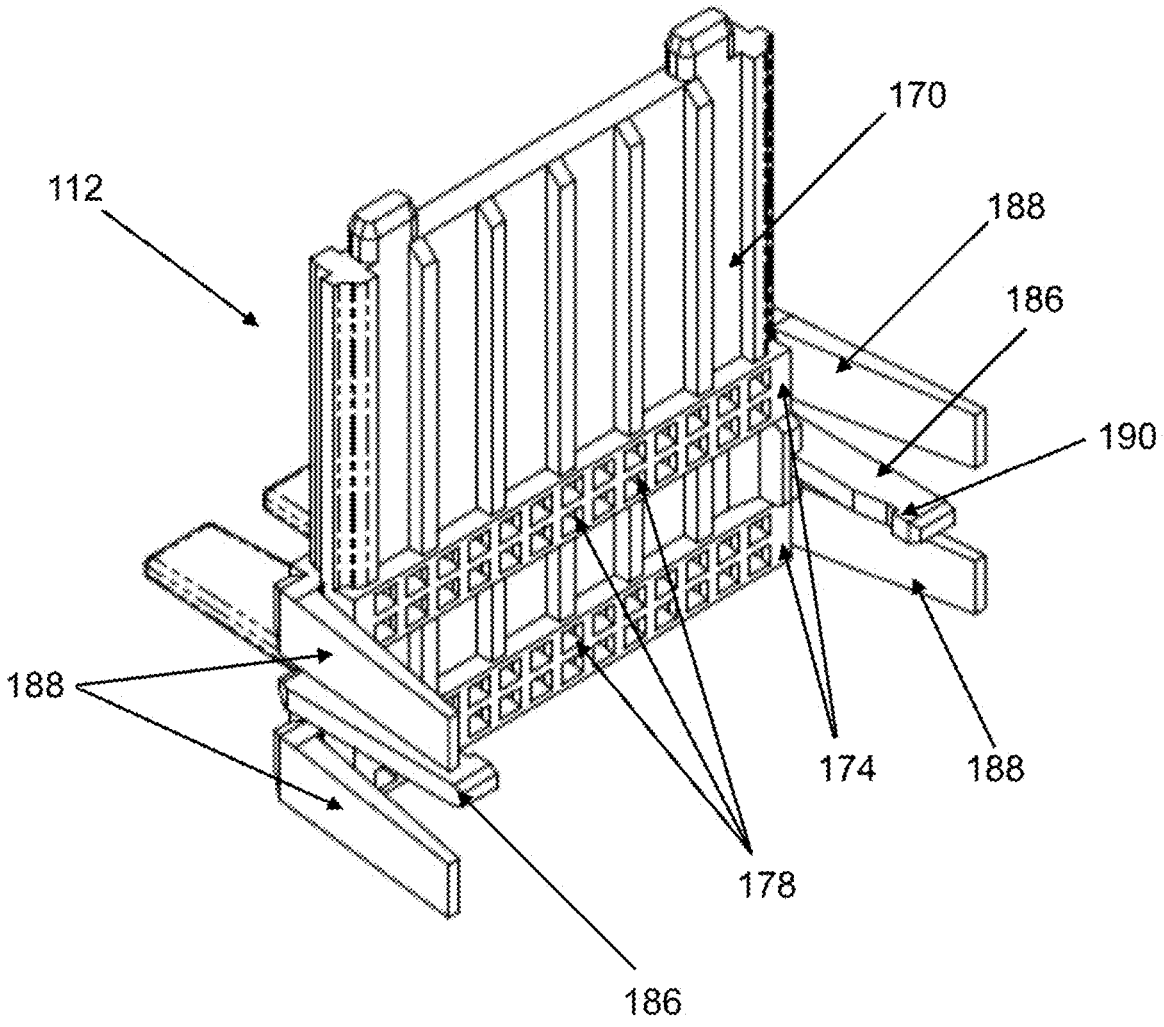
FIG. 21 shows a top rear perspective view of the bulkhead of the second embodiment of the connector biscuit.

Referring now to FIGS. 20 and 21, the bulkhead 112 may be composed of thermoplastic and may also be a unitary or monolithic structure. The bulkhead 112 comprises a generally rectangular main body 170 that includes a plurality of vertically-extending, spaced-apart ribs and a pair of laterally-extending, spaced-apart braces 174. A pair of tabs or ears 176 extend upwardly from a top edge of the main body 170 and are located toward outer sides of the main body 170, respectively. Each of the braces 174 has rows of rectangular passages 178 extending therethrough. A main tongue 182 and two outer tongues 184 are joined to the main body, between the braces 174, and extend forwardly therefrom. The main tongue 182 is larger than the outer tongues 184 and is disposed between the two.

On each side of the bulkhead 112, a rail 186 and a pair of spaced-apart latches 188 extend rearwardly from the main body 170, with the rail 186 being disposed between the two latches 188. Each latch 188 is joined, at one end, to an end of one of the braces 174, and each rail 186 is joined, at one end, to a side of the main body 170, between the braces 174. The latches 188 and the rails 186 are all resiliently deflectable. However, the latches 188 are resiliently deflectable inwardly, while the rails 186 are resiliently deflectable outwardly, as will be described more fully below. A hook 190 is formed in each rail 186, at its free end. Inner sides of the rails 186 are adapted to be received in the grooves of the comb 110, respectively, while outer sides of the rails 186 are adapted to be received in the grooves of the side tracks 32 of the interior walls 28, respectively. Free ends of the latches 188 are adapted to engage the stop projections 34 of the interior walls 28.

Figure 22:
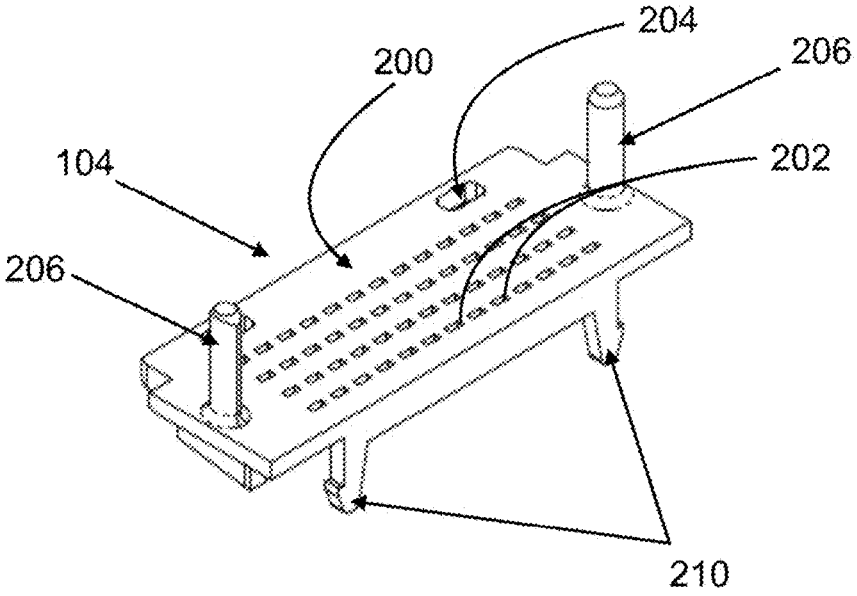
FIG. 22 shows a top rear perspective view of a keeper of the second embodiment of the connector biscuit.
Figure 23:
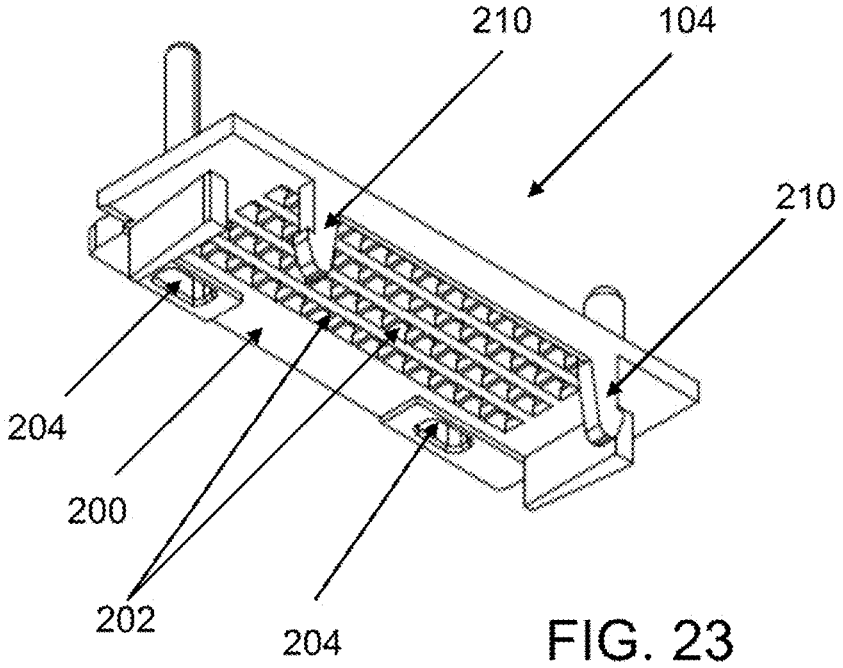
FIG. 23 shows a bottom rear perspective view of the keeper of the second embodiment of the connector biscuit.

Referring now to FIGS. 22 and 23, the keeper 104 may be composed of thermoplastic and may also be a unitary or monolithic structure. The keeper 104 includes a rectangular panel 200 having a matrix of rectangular passages 202 extending therethrough. A pair of spaced-apart rectangular openings 204 are formed in the panel 200, toward a front edge thereof. A pair of pillars 206 are joined to the panel 200 and extend upwardly therefrom. The pillars 206 are disposed toward side edges of the panel 200, respectively. The pillars 206 may extend through openings in the electronic/electrical device (e.g. a PCB) and, as such, may help align and secure the electronic/electrical device to the connector biscuit 100. A flange with a pair of snap-fit protrusions 210 extending downwardly therefrom is joined to a bottom surface of the panel 200 at a rear edge thereof. The snap-fit protrusions 210 are adapted to be snap-fit into the snap-fit openings 154 of the comb 110.

The mounting block 102 is formed by mounting the contact wafers 108 to one of the comb 110 and the bulkhead 112 and then securing together the comb 110 and the bulkhead 112, with the contact wafers 108 disposed in-between. More preferably, the contact wafers 108 are mounted to the bulkhead 112 first and then the comb 110 is secured to the bulkhead 112.

The contact wafers 108 are mounted to the bulkhead 112, beginning with contact wafer 108*a*. The lower sections of the contacts 116*a* of the contact wafer 108*a* are inserted into a top row of the passages 178 of the upper brace 174 and then the housing 118 is pushed forward until it abuts the upper brace 174. The lower sections of the contacts 116*b* of the contact wafer 108*b* are then inserted into the bottom row of the passages 178 of the upper brace 174 and then the housing 118 of the contact wafer 108*b* is pushed forward until it abuts the housing 118 of contact wafer 108*a*. The contact wafer 108*c* and then the contact wafer 108*d* are mounted to the bulkhead 112 in the same manner such that the lower sections of the contacts 116*c* of the contact wafer 108*c* extend through the top row of the passages 178 of the lower brace 174 and the lower sections of the contacts 116*d* of the contact wafer 108*d* extend through the bottom row of the passages 178 of the lower brace 174.

The mounting of the contact wafers 108 to the bulkhead 112 as described above forms a nested stack of the contact wafers 108, which is disposed adjacent to the main body 170. The stacked contact wafers 108 form columns of exposed portions of the contacts 116*a,b,c,d*. These columns are laterally spaced apart and extend across the width of the stack. The exposed portions of the contacts 116*a,b,c,d* include the angled middle sections and the horizontal lower sections.

After the contact wafers 108 are mounted to the bulkhead 112, the comb 110 is aligned with the bulkhead 112 such that the slots 162 in the base 152 are aligned with the exposed portions of the contacts 116*a,b,c,d*, respectively, and the grooves of the base 152 are aligned with the rails 186 of the bulkhead 112, respectively. The comb 110 and the bulkhead 112 are then brought together. As the inner sides of the rails 186 move through the grooves, the free ends slide over the sloping surfaces of the catches 168 and are deflected outward to permit continued movement. Once the free ends of the rails 186 clear end edges of the catches 168, the rails 186 resiliently move inward, which causes the hooks 190 of the rails 186 to engage the end edges of the catches 168, thereby securing together the comb 110 and the bulkhead 112, with the contact wafers 108 disposed in-between.

With the mounting block 102 formed as described above, each slot 162 of the comb 110 has disposed therein the middle and lower sections of contacts 116*a,b,c,d* from the four different contact wafers 108*a,b,c,d*, respectively, wherein in each slot 162, the contacts 116 are arranged in the order 116*a*, then 116*b*, then 116*c* and then 116*d*, with the contact 116*a* being the frontmost and the contact 116*d* being the rearmost (toward the back panel 150). In addition, the contacts 116 form a matrix of evenly spaced tail ends 120 that protrude upward from the contact wafers 108 on a top side of the mounting block 102. As shown, the matrix may comprise columns of four tail ends 120 and rows of a larger number of tail ends 120. The contacts 116 also form two spaced-apart pairs of rows of connecting ends (pins) 122 protruding outward from the braces 174 on a front side of the mounting block 102. The main tongue 182 and the outer tongues 184 are disposed between the pairs of rows of pins 122 and extend farther forward.

The outline of the keeper 104 substantially corresponds to the outline of the top side of the mounting block 102 and the matrix of passages 202 in the keeper 104 corresponds to and aligns with the matrix of contact tail ends 120 protruding from the mounting block 102. The keeper 104 is connected to the mounting block 102 by aligning the matrix of keeper passages 202 with the matrix of contact tail ends 120. In addition, the openings 204 of the keeper 104 are aligned with the ears 176 of the bulkhead 112, and the snap-fit protrusions 210 of the keeper 104 are aligned with the snap-fit openings 154 of the comb 110. The keeper 104 is then pressed downward, toward the mounting block 102, which causes the tail ends 120 of the contacts 116 to pass through the passages 202 of the keeper 104 and the retainers 126 of the contacts 116 to be pressed into engagement with interior walls defining the passages 202. In addition, the ears 176 of the bulkhead 112 are pressed through the openings 204 in the keeper 104 and the snap-fit protrusions 210 of the keeper 104 are snap-fit into the snap-fit openings 154 of the comb 110. In this manner, the keeper 104 is secured to the mounting block 102.

Figure 24:
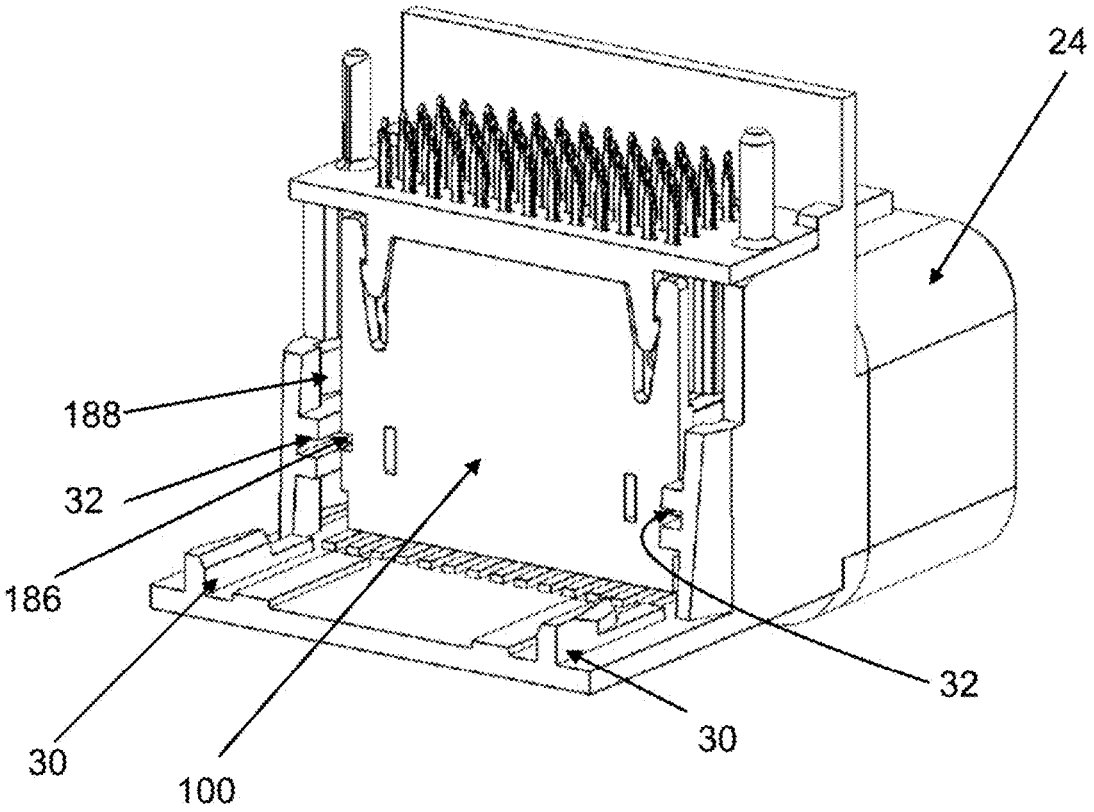
FIG. 24 shows a rear perspective view of a portion of the enclosure with the second embodiment of the connector biscuit mounted thereto.
Figure 25:
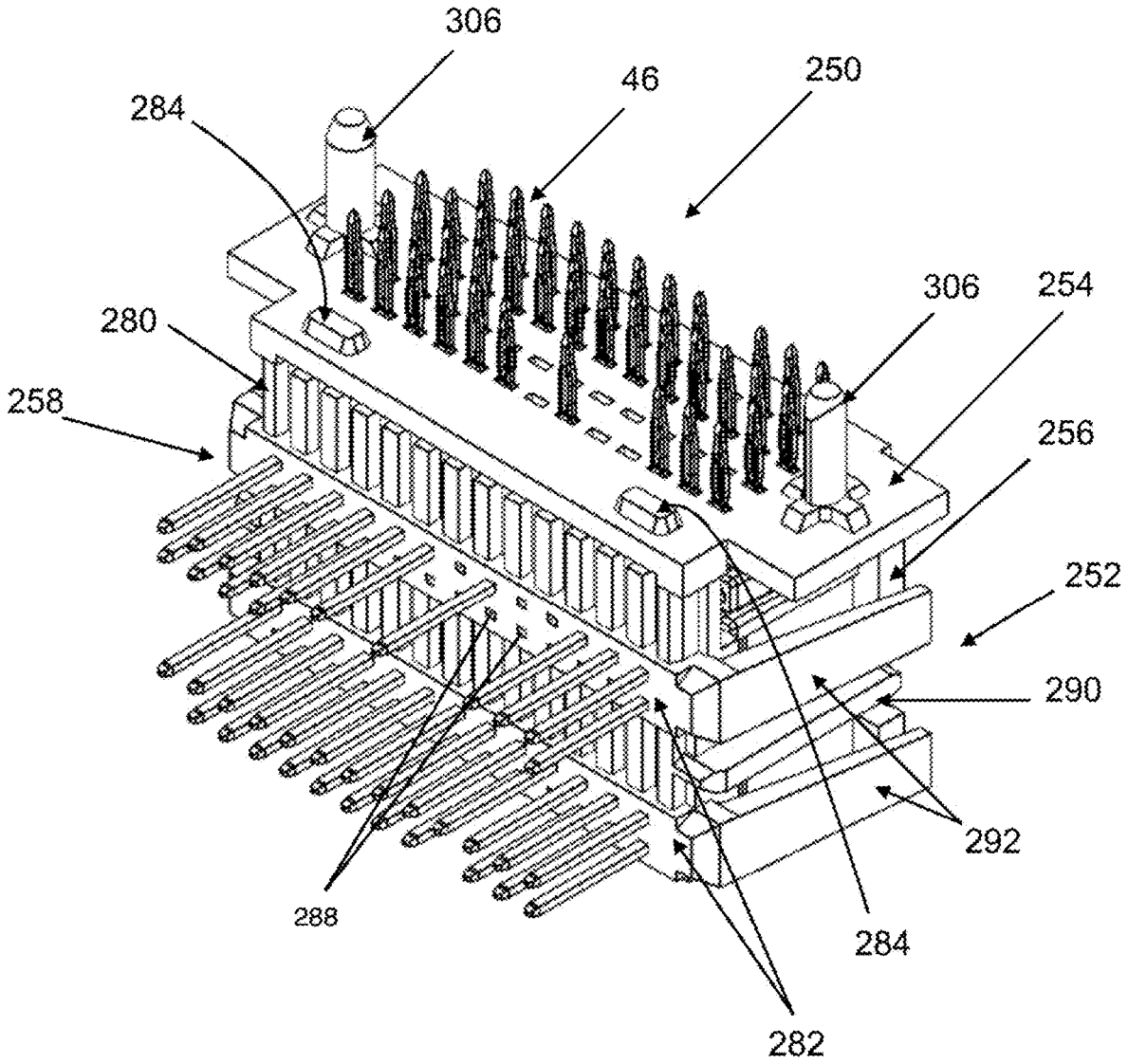
FIG. 25 shows a top front perspective view of a third embodiment of a connector biscuit.
Figure 26:
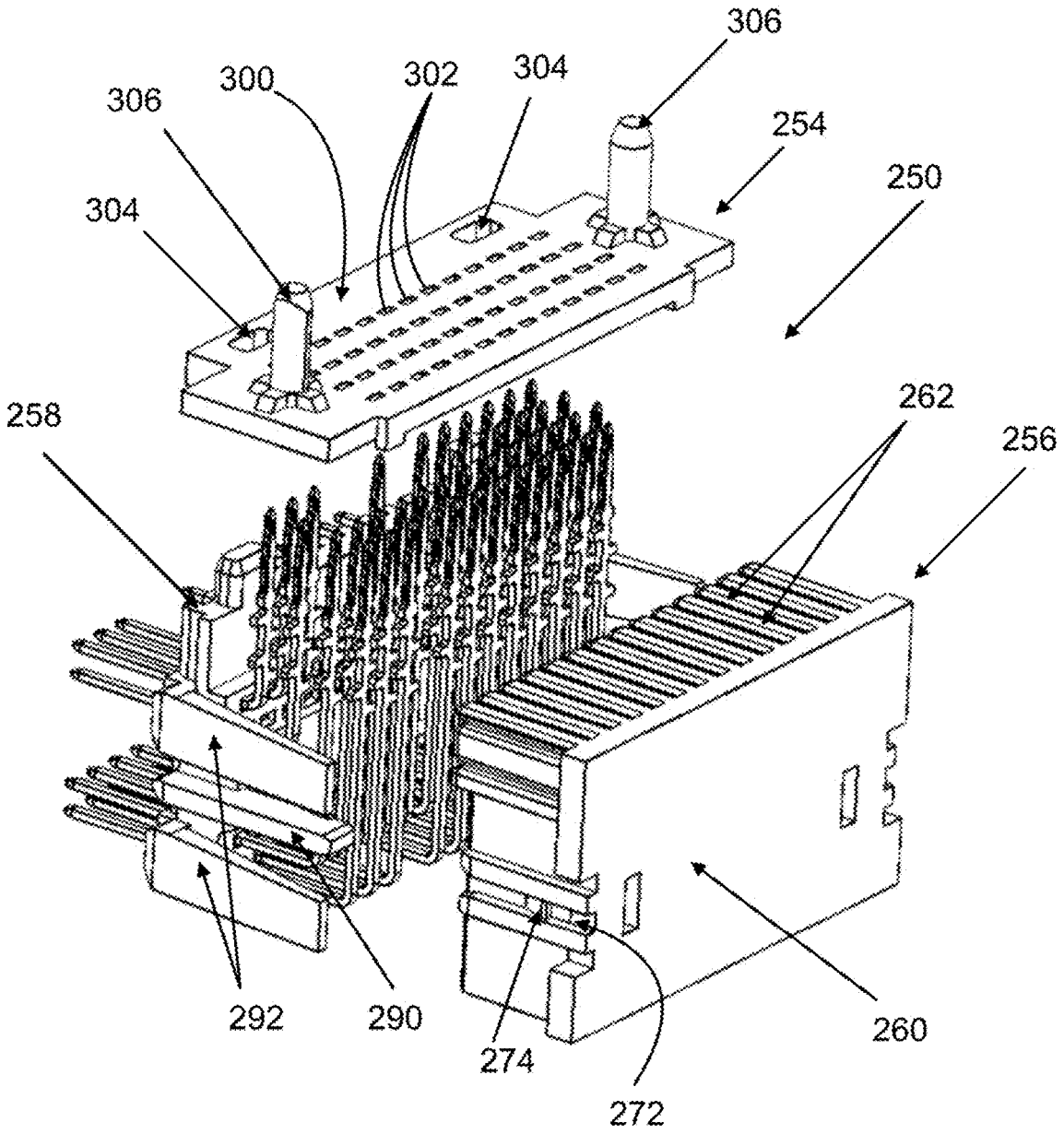
FIG. 26 shows a partially exploded side rear perspective view of the third embodiment of the connector biscuit.

Referring now to FIG. 24, the connector biscuit 100 is shown mounted to the enclosure 12, only a portion of which is shown. The connector biscuit 100 is mounted to the enclosure by first placing the connector biscuit 100 inside the enclosure 12, with the mounding block 102 resting on the bottom wall 14 and disposed between the bottom tracks 30. The connector biscuit 100 is then pushed forward such that the outer sides of the rails 186 of the bulkhead 112 enter and move through the grooves of the side tracks 32 of the interior walls 28. This forward movement deflects the latches 188 of the bulkhead 112 inwardly, towards the base 152 of the comb 110, which allows the latches 188 to move between the interior walls 28. Forward movement of the connector biscuit 100 ceases when the front side of the mounting block 102 contacts front stops of the enclosure 12. At this point, the free ends of the latches 188 just clear the stop projections 34, which allows the latches 188 to move outward and place the free ends in close proximity with forward surfaces of the stop projections 34, thereby preventing rearward movement of the connector biscuit 100. The connector biscuit 100 is now secured within the enclosure 12, with the connector ends 122 of the contacts 116 being disposed inside the shroud 24 and the tail ends 120 of the contacts 116 being disposed inside the cavity of the enclosure 12.

The connector biscuit 100 may be removed from the enclosure 12 by manually deflecting the latches 188 inward and then pulling the connector biscuit 100 rearward so that is slides through the side tracks 32 and then the bottom tracks 30 until it is free. The connector biscuit 100 may then be lifted upward, out of the enclosure 12.

Referring now to FIGS. 25-28 there is shown a connector biscuit 250 constructed in accordance with an exemplary third embodiment. The connector biscuit 250 generally includes a body comprising a mounting block 252 and a keeper 254, with a plurality of the contacts 46 mounted thereto. The mounting block 252 comprises a comb 256 that is releasably fastened to a bulkhead 258.

Figure 27:
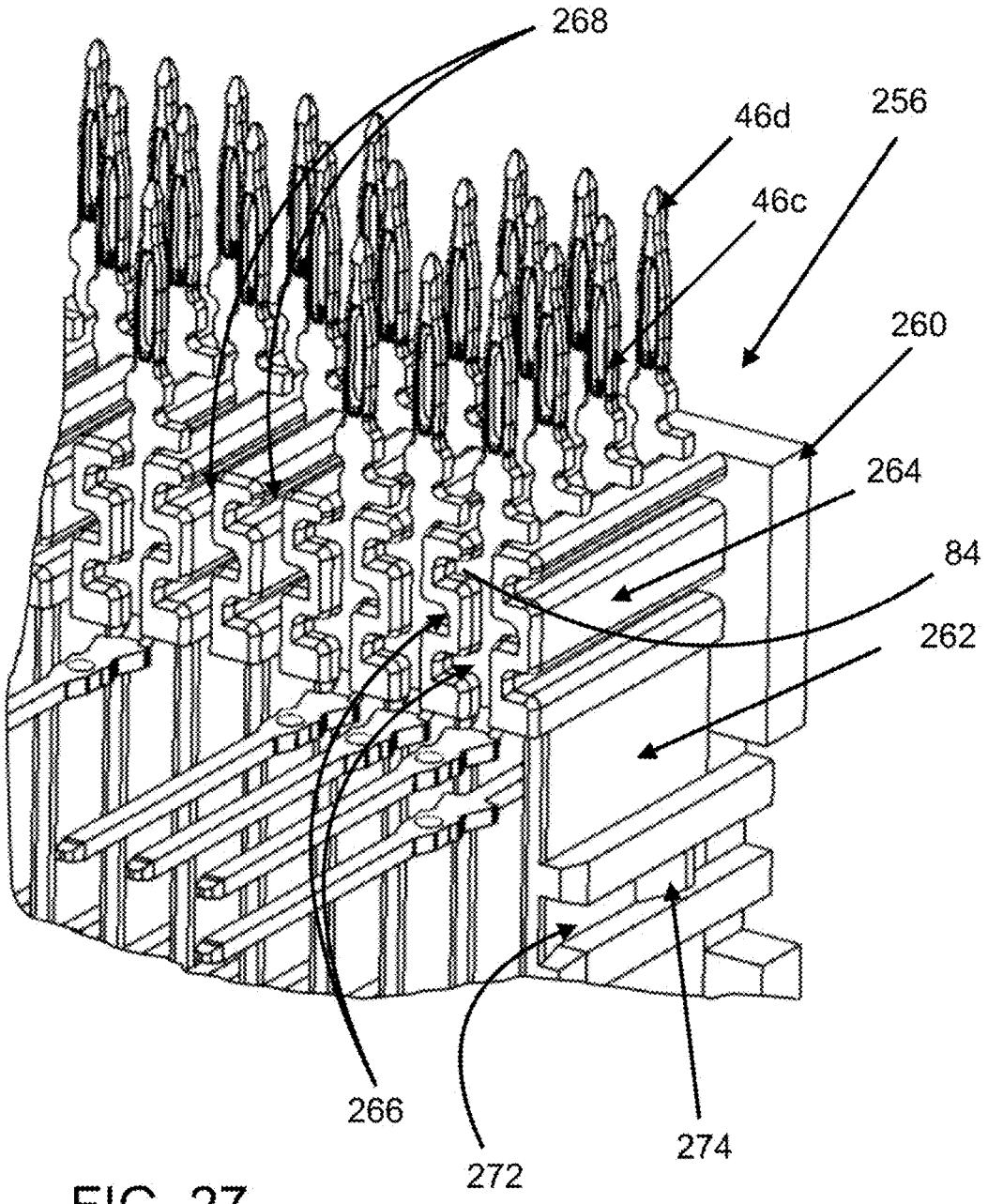
FIG. 27 shows a front perspective view of a portion of a comb of the third embodiment of the connector biscuit, with contacts mounted thereto.

The comb 256 may be composed of thermoplastic and may be a unitary or monolithic structure. The comb 256 includes a rear wall 260 joined to posterior ends of a series of sidewalls 262, which extend forwardly from the rear wall 260. Each sidewall 262 includes an upper crenelated portion 264 having a plurality of channels 266, at least two of which are oppositely-directed. As shown in FIG. 27, each sidewall 262 may have two channels 266 opening in one direction and a third channel 266 opening in an opposite, second direction. The sidewalls 262 are spaced-apart to form a series of parallel slots 268. Each slot 268 is defined by a sidewall 262 having a pair of channels 266 opening into the slot 268 and an opposing sidewall 262 having a single channel 266 opening into the slot 268, with the single channel 266 in the one sidewall 262 being vertically positioned between the pair of channels 266 in the other sidewall 262. Outermost ones of the sidewalls 262 each include a pair of protruding beams defining a groove 272 therebetween. Wedge-shaped catches 274 are disposed in the grooves 272.

The bulkhead 258 may be composed of thermoplastic and may be a unitary or monolithic structure. The bulkhead 258 comprises a generally rectangular main body 280 that includes a plurality of vertically-extending, spaced-apart ribs and a pair of laterally-extending, spaced-apart braces 282. A pair of tabs or ears 284 extend upwardly from a top edge of the main body 280 and are located toward outer sides of the main body 280, respectively. Each of the braces 282 has rows of rectangular passages 288 extending therethrough.

On each side of the bulkhead 258, a rail 290 and a pair of spaced-apart latches 292 extend rearwardly from the main body 280, with the rail 290 being disposed between the two latches 292. Each latch 292 is joined, at one end, to an end of one of the braces 282, and each rail 290 is joined, at one end, to a side of the main body 280, between the braces 282. The latches 292 and the rails 290 are all resiliently deflectable. However, the latches 292 are resiliently deflectable inwardly, while the rails 290 are resiliently deflectable outwardly, as will be described more fully below. A hook is formed in each rail 290, at its free end. Inner sides of the rails 290 are adapted to be received in the grooves 272 of the comb 256, respectively, while outer sides of the rails 290 are adapted to be received in the grooves of the side tracks 32, respectively, of the interior walls 28 of the enclosure 12. Free ends of the latches 292 are adapted to engage the stop projections 34 of the interior walls 28.

The upper and middle sections of the contacts 46 are mounted in the slots 268 of the comb 256 such that each slot 268 may contain the upper and middle sections of up to one set of the four contacts 46*a,b,c,d*. The three inner or lower retention tabs 84 of each contact 46 are disposed in the channels 266 of a slot 268, respectively, while the uppermost retention tab 84 rests on a top surface of a sidewall 262, as shown in FIG. 27. The retention tabs 84 help secure the contacts 46 in the comb 256. In each slot 268 containing a full set of the contacts 46*a,b,c,d*, the contacts 46 are arranged in the order 46*a*, then 46*b*, then 46*c* and then 46*d*, with the contact 46*a* being the frontmost and the contact 46*d* being the rearmost. It should be appreciated that not every slot 268 has to contain a full set of contacts 46*a,b,c,d*. Indeed, some slots 64 may contain one, two or three contacts 46 or no contacts 46 at all.

The lower sections of the contacts 46 extend through the passages 288 in the braces 282 of the bulkhead 258, with the barbs 80 of the contacts 46*a,b* being disposed in the passages 288 of an upper one of the braces 282 and the barbs 80 of the contacts 46*c,d* being disposed in the passages 288 of a lower one of the braces 282.

The mounting block 252 is formed by mounting the contacts 46 to one of the comb 256 and the bulkhead 258 and then securing together the comb 256 and the bulkhead 258, with the contacts 46 disposed in-between. The comb 256 and the bulkhead 258 are secured together by aligning the inner sides of the rails 290 of the bulkhead 258 with the grooves 272 of the comb 256 and then moving the two structures together. As the rails 290 move through the grooves 272, their free ends slide over the sloping surfaces of the catches 274 and are deflected outward to permit continued movement. Once the free ends of the rails 290 clear end edges of the catches 274, the rails 290 resiliently move inward, which causes the hooks of the rails 290 to engage the end edges of the catches 274, thereby securing together the comb 256 and the bulkhead 258, with the contacts 46 disposed in-between.

The keeper 254 is composed of plastic and may also be a unitary or monolithic structure. The keeper 254 includes a rectangular panel 300 having a matrix of rectangular passages 302 extending therethrough. A pair of spaced-apart rectangular openings 304 are formed in the panel 300, toward a front edge thereof. A pair of pillars 306 are joined to the panel 300 and extend upwardly therefrom. The pillars 306 are disposed toward side edges of the panel 300, respectively. The pillars 306 may extend through openings in the electronic/electrical device (e.g. a PCB) and, as such, may help align and secure the electronic/electrical device to the connector biscuit 250.

The outline of the keeper 254 substantially corresponds to the outline of the top side of the mounting block 252 and the matrix of passages 302 in the keeper 254 corresponds to and aligns with the matrix of contact tail ends 76 protruding from the mounting block 252. The keeper 254 is connected to the mounting block 252 by aligning the matrix of keeper passages 302 with the matrix of contact tail ends 76. In addition, the openings 304 of the keeper 254 are aligned with the ears 284 of the bulkhead 258. The keeper 254 is then pressed downward, toward the mounting block 252, which causes the tail ends 76 of the contacts 46 to pass through the passages 302 of the keeper 254 and the retainers 77 of the contacts 46 to be pressed into engagement with interior walls defining the passages 302. In addition, the ears 284 of the bulkhead 258 are pressed through the openings 304 in the keeper 104. In this manner, the keeper 254 is secured to the mounting block 252.

Figure 28:
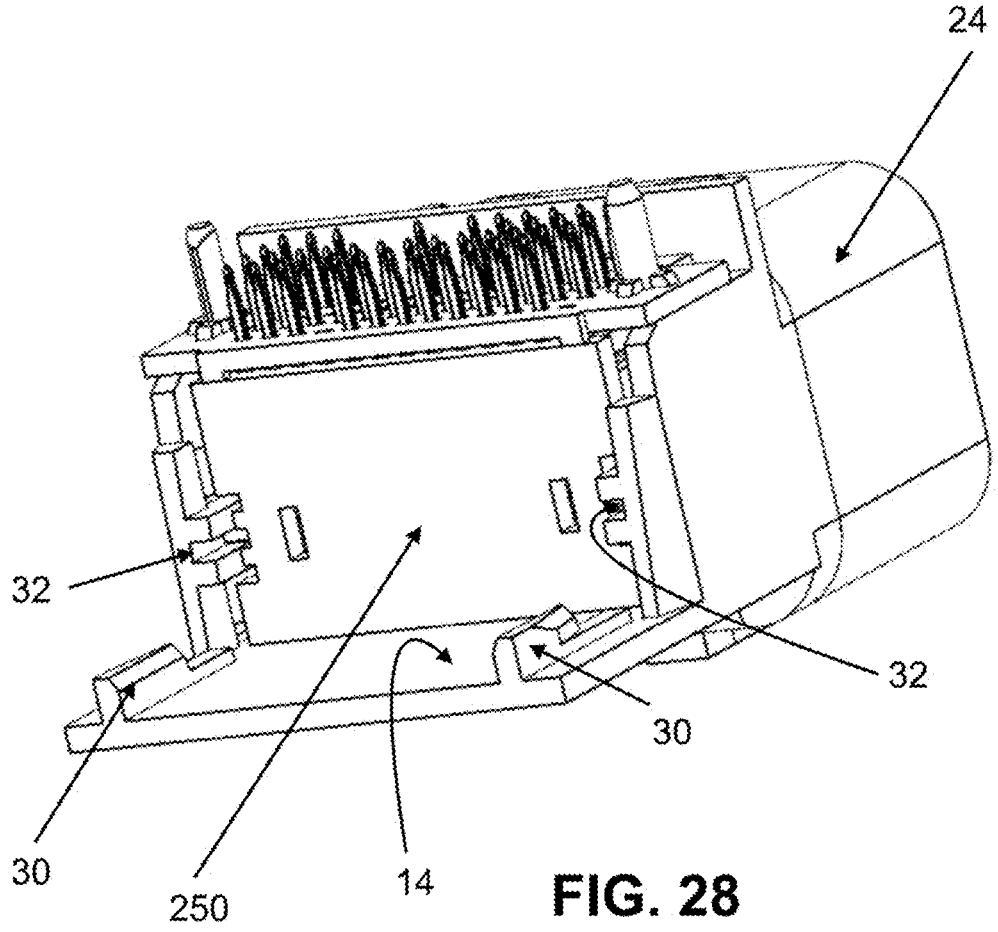
FIG. 28 shows a rear perspective view of a portion of the enclosure with the third embodiment of the connector biscuit mounted thereto.

As shown in FIG. 28, the connector biscuit 250 is shown mounted to the enclosure 12, only a portion of which is shown. The connector biscuit 250 is mounted to the enclosure 12 by first placing the connector biscuit 250 inside the enclosure 12, with the mounting block 252 resting on the bottom wall 14 and disposed between the bottom tracks 30. The connector biscuit 250 is then pushed forward such that the outer sides of the rails 290 of the bulkhead 258 enter and move through the grooves of the side tracks 32 of the interior walls 28. This forward movement deflects the latches 292 of the bulkhead 258 inwardly, towards the comb 256, which allows the latches 292 to move between the interior walls 28. Forward movement of the connector biscuit 250 ceases when the front side of the mounting block 252 contacts front stops of the enclosure 12. At this point, the free ends of the latches 292 just clear the stop projections 34, which allows the latches 292 to move outward and place the free ends in close proximity with forward surfaces of the stop projections 34, thereby preventing rearward movement of the connector biscuit 250. The connector biscuit 250 is now secured within the enclosure 12, with the connector ends 78 of the contacts 46 being disposed inside the shroud 24 and the tail ends 76 of the contacts 46 being disposed inside the cavity of the enclosure 12.

Figure 29:
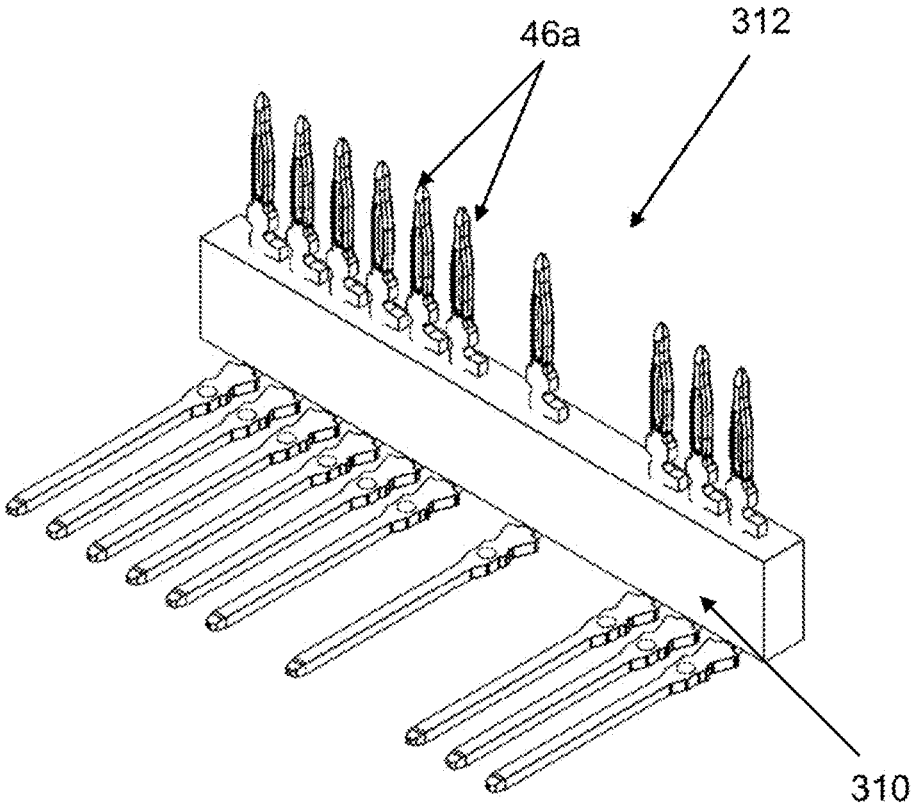
FIG. 29 show a top front perspective view of a contact module of a fourth embodiment of a connector biscuit, wherein the contact module includes a row of contacts overmolded with a plastic bar.

In a fourth embodiment, the connector biscuit 250 may be modified by having each row of the contacts 46 overmolded with a plastic bar 310 to form a contact module 312, such as is shown in FIG. 29 for the row of contacts 46*a*. In this embodiment, the comb has the same construction as the comb 256, except the upper crenelated portions 264 of the sidewalls 262 are removed to accommodate the plastic bars 310, which rest on top of the shortened sidewalls 262. The middle sections of the contacts 46 are disposed in the shortened slots 268 of the comb.

It is to be understood that the description of the foregoing exemplary embodiment(s) is (are) intended to be only illustrative, rather than exhaustive. Those of ordinary skill will be able to make certain additions, deletions, and/or modifications to the embodiment(s) of the disclosed subject matter without departing from the spirit of the disclosure or its scope.

What is claimed is:

1. A connector housing for an electronic/electrical device, the connector housing comprising:

an enclosure defining an interior space in which the electronic/electrical device may be disposed, the enclosure including a wall with an opening extending therethrough and a shroud joined to and extending from the wall; and a header connector secured to the enclosure so as to extend through the opening in the wall, the header connector comprising:

a plastic mounting block having a plurality of sidewalls joined to, and extending from, a laterally-extending structure, the sidewalls being spaced apart to define a plurality of slots arranged in a lateral direction;

a plurality of contacts at least partially disposed in the slots of the mounting block, respectively, the contacts being arranged in a plurality of rows that each extend in the lateral direction such that a plurality of the slots each contain a plurality of the contacts from different ones of the rows, with each of the slots containing not more than one of the contacts from any one of the rows, the contacts each having a first section and a second section, the first section including a connector end disposed inside the shroud and the second section including a plurality of retention tabs and a tail end for connection to the electronic/electrical device, the retention tabs extending in the lateral direction and engaging the mounting block to help secure the contacts to the mounting block; and a keeper connected to the mounting block, the keeper having a plurality of passages through which the contacts extend, respectively, so that the tail ends of the contacts protrude from an outer surface of the keeper.

2. The connector housing of claim 1, wherein in each contact, a first one of the retention tabs extends to one side of the contact and a second one of the retention tabs extends to another, opposing side of the contact.

3. The connector housing of claim 1, wherein the sidewalls define a plurality of channels that extend parallel to the slots, and wherein in each slot, at least two channels open into the slot from opposing sides of the slot.

4. The connector housing of claim 3, wherein in each slot containing one of the contacts, the retention tabs of the contact are disposed in the channels opening into the slot.

5. The connector housing of claim 4, wherein each sidewall of the mounting block includes an upper crenelated portion having two of the channels opening in one direction and a third of the channels opening in an opposite, second direction.

6. The connector housing of claim 5, wherein each slot is defined by one of the sidewalls having a pair of the channels opening into the slot and an opposing one of the sidewalls having a single one of the channels opening into the slot, with the single one of the channels in the opposing one of the sidewalls being vertically positioned between the pair of the channels in the one of the sidewalls.

7. The connector housing of claim 6, wherein each contact has a pair of retention tabs extending from one side of the contact and another pair of retention tabs extending from the other side of the contact, and wherein the retention tabs are arranged in a staggered configuration along a length of the contact.

8. The connector housing of claim 1, wherein each contact is L-shaped and wherein in each contact, the tail end has a press-fit configuration and the connector end is configured as a pin.

9. The connector housing of claim 1, wherein the mounting block further comprises a plurality of contact wafers, each of the contact wafers comprising a plurality of the contacts, the contacts being secured to and projecting from a housing.

10. The connector housing of claim 9, wherein the housing is composed of plastic and is molded over the contacts.

11. The connector housing of claim 9, wherein one of the contact wafers has contacts that are longer than the contacts of another one of the contact wafers.

12. The connector housing of claim 9, wherein the mounting block further comprises a monolithic comb and a monolithic bulkhead, the comb comprising the laterally-extending structure and the sidewalls, and wherein the contact wafers are held between the comb and the bulkhead.

13. The connector housing of claim 12, wherein the comb is releasably secured to the bulkhead by latching systems disposed on opposite lateral sides of the mounting block, respectively.

14. The connector housing of claim 13, wherein the keeper is fastened to the comb by one or more snap-fit connections.

15. The connector housing of claim 1, wherein the mounting block includes a guide system that helps guide the header connector into the enclosure and a fastening system for releasably securing the header connector within the enclosure.

16. The connector housing of claim 15, wherein the mounting block further comprises a comb and a bulkhead, the comb comprising the laterally-extending structure and the sidewalls, and wherein the comb and the bulkhead are releasably secured together.

17. The connector housing of claim 16, wherein the fastening system and the guide system are part of the bulkhead.

18. The connector housing of claim 1, wherein each contact is L-shaped and further comprises a middle section that connects the first section to the second section, the middle section including a bend, and wherein in each of the slots containing contacts, the bends of the contacts are disposed between a pair of the sidewalls.

19. The connector housing of claim 18, wherein the mounting block is monolithic, wherein the laterally-extending structure has a plurality of passages through which the first sections of the contacts extend such that the connector ends of the contacts protrude from a front surface of the laterally extending structure, and wherein the sidewalls extend rearwardly beyond the bends of the contacts.

* * * * *